US008259059B2

(12) United States Patent
Park et al.

(10) Patent No.: US 8,259,059 B2
(45) Date of Patent: Sep. 4, 2012

(54) DRIVING SYSTEM CAPABLE OF IMPROVING CONTRAST RATIO FOR LIQUID CRYSTAL DISPLAY DEVICE, LIQUID CRYSTAL DISPLAY DEVICE INCLUDING THE SAME, AND DRIVING METHOD USING THE SAME

(75) Inventors: Joon Ha Park, Goyang-si (KR); Sang Kyu Park, Paju-si (KR); Jae Woo Lee, Paju-si (KR); Hee Jung Hong, Seoul (KR); Kyung Joon Kwon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1013 days.

(21) Appl. No.: 12/230,418

(22) Filed: Aug. 28, 2008

(65) Prior Publication Data

US 2009/0201244 A1 Aug. 13, 2009

(30) Foreign Application Priority Data

Feb. 12, 2008 (KR) ..... 10-2008-0012431
Feb. 12, 2008 (KR) ..... 10-2008-0012531
Feb. 14, 2008 (KR) ..... 10-2008-0013390
Mar. 4, 2008 (KR) ..... 10-2008-0019910
Jun. 20, 2008 (KR) ..... 10-2008-0058223

(51) Int. Cl.
*G09G 3/36* (2006.01)

(52) U.S. Cl. ..... 345/102

(58) Field of Classification Search ..... 345/102; 349/61–70; 362/561
See application file for complete search history.

(56) References Cited

U.S. PATENT DOCUMENTS 5,717,422 A 2/1998 Fergason
6,268,843 B1 7/2001 Arakawa
6,816,141 B1 11/2004 Fergason
6,891,672 B2 5/2005 Whitehead et al.
7,106,505 B2 9/2006 Whitehead et al.
7,172,297 B2 2/2007 Whitehead et al.
7,352,347 B2 4/2008 Fergason
7,370,979 B2 5/2008 Whitehead et al.
2002/0063534 A1 * 5/2002 Min ..... 315/169.3
2008/0055230 A1 * 3/2008 Jang et al. ..... 345/102
2008/0129679 A1 * 6/2008 Yamamoto ..... 345/102

FOREIGN PATENT DOCUMENTS

JP 60-125891 7/1985
JP 03-125333 U 12/1991
JP 05-066501 3/1993
JP 05-188345 7/1993
KR 1020020041733 A 6/2002
KR 1020070002176 A 1/2007

* cited by examiner

*Primary Examiner* — Chanh Nguyen
*Assistant Examiner* — Ram Mistry
(74) *Attorney, Agent, or Firm* — Morgan, Lewis & Bockius LLP

(57) ABSTRACT

A driving system for a liquid crystal display device includes a system unit to supply image data to be displayed on a liquid crystal panel, the system unit generating a system dimming signal, an inverter unit to control luminance of a backlight unit, the inverter unit receiving the system dimming signal, and a control unit to control display of images on the liquid crystal panel, the control unit receiving the system dimming signal from the inverter unit and outputting a control dimming signal to the inverter unit, wherein the inverter unit adjusts luminance of the backlight unit using the control dimming signal input from the control unit.

26 Claims, 11 Drawing Sheets

| analog DC voltage | high width ratio of converted PWM signal | waveform of converted PWM signal |
|---|---|---|
| 3.3V | 100% | 1 0 |
| 3.2V | 98% | 1 0 |
| ⋮ | ⋮ | ⋮ |
| 0.0V | 30% | 1 0 |

*FIG. 10*

DRIVING SYSTEM CAPABLE OF IMPROVING CONTRAST RATIO FOR LIQUID CRYSTAL DISPLAY DEVICE, LIQUID CRYSTAL DISPLAY DEVICE INCLUDING THE SAME, AND DRIVING METHOD USING THE SAME

This application claims the benefit of Korean Patent Application No. 2008-0012431 filed on Feb. 12, 2008, Korean Patent Application No. 2008-0012531 filed on Feb. 12, 2008, Korean Patent Application No. 2008-0013390 filed on Feb. 14, 2008, Korean Patent Application No. 2008-0019910 filed on Mar. 4, 2008, and Korean Patent Application No. 2008-0058223 filed on Jun. 20, 2008, which are hereby incorporated by references in their entirety.

BACKGROUND OF THE INVENTION

1. Field of the Invention

The present application relates to a liquid crystal display device, and more particularly, to a driving system for a liquid crystal display device including a liquid crystal panel and a backlight unit, a liquid crystal display device including the driving system, and a driving method using the driving system.

2. Discussion of the Related Art

Liquid crystal display (LCD) devices having thin profiles, light weight, and low power consumption have been used in notebook computers, office automation devices, audio/video devices, and the like. Among the various types of LCD devices, active matrix LCD (AM-LCD) devices that employ switching elements and pixel electrodes arranged in a matrix structure are the subject of significant research and development because of their high resolution and superior suitability for displaying moving images. Thin film transistor LCD (TFT-LCD) devices use thin film transistors (TFTs) as the switching elements.

FIG. 1 is a view showing a liquid crystal display device according to the related art. In FIG. 1, the LCD device includes a liquid crystal panel 10, a backlight unit 20, a control unit 30, a system unit 40, and an inverter unit 50. The liquid crystal panel 10 includes a plurality of pixels to display images corresponding to applied data signals, and the backlight unit 20 includes an illuminating means to supply light to the liquid crystal panel 10. The control unit 30 includes a timing controller to control display of the images via the data signals supplied to the liquid crystal panel 10. The system unit 40 includes an external interface circuit, such as a television system or a graphic card, to supply image data corresponding to the data signals and various driving signals to the control unit 30. In addition, the inverter unit 50 controls illumination of the backlight unit 20 and receives a dimming signal for adjusting illumination of the backlight unit 20 from the control unit 30 or the system unit 40.

Recently, a driving method of an LCD device that improves contrast ratio has been suggested. In the driving method, contrast ratio is improved by reducing luminance of the backlight unit for images within a low gray level range, specifically an image corresponding to black. Accordingly, display quality is improved while reducing power consumption. For example, the image data within the low gray level range may be converted to have a higher gray level and the luminance of the backlight unit may be reduced.

FIG. 2 is a view showing a driving system for improving contrast ratio for a liquid crystal display device according to the related art. In FIG. 2, the driving system includes a control unit 30, a system unit 40, and an inverter unit 50. The system unit 40 supplies dimming signals to the inverter unit 50 through a second cable CB2 connecting a first system connector 44 and a first inverter connector 52. The dimming signals may be classified into A and B types. The A type dimming signal is an analog direct current (DC) voltage signal while the B type dimming signal is one of a pulse width modulation (PWM) signal and an analog DC voltage signal. Accordingly, the system unit 40 supplies a first B type dimming signal VBR-B1 to the control unit 30 through a first cable CB1 connecting a second system connector 42 and a first control connector 34.

When the system unit 40 supplies a dynamic contrast ratio (DCR) enable signal DCR-EN to the control unit 30, a timing controller 32 of the control unit 30 generates a timing controller dimming signal DACOUT of an analog DC voltage signal corresponding to the data signal. One of the first B type dimming signal VBR-B1 supplied from the system unit 40 and the timing controller dimming signal DACOUT generated by the timing controller 32 is selected through a first multiplexer M1 of the control unit 30. The control unit 30 supplies the selected dimming signal as a second B type dimming signal VBR-B2 to the system unit 40 through the first cable CB1.

One of the first and second B type dimming signals VBR-B1 and VBR-B2 is selected through a second multiplexer M2 in the system unit 40. The system unit 40 supplies an A type dimming signal VBR-A and the selected dimming signal as a B type dimming signal VBR-B to the inverter unit 50 through the second cable CB2 connecting the first system connector 44 and the first inverter connector 52. The inverter unit 50 adjusts luminance and lighting period of the backlight unit of the LCD device using the A and B type dimming signals VBR-A and VBR-B.

Accordingly, the control unit 30 selects one of the timing controller dimming signal DACOUT generated by the control unit 30 and the first B type dimming signal VBR-B1 supplied by the system unit 40 as the second B type dimming signal VBR-B2. The selected dimming signal (i.e., DACOUT or VBR-B1) is supplied as the second B type dimming signal VBR-B2 to the system unit 40. The system unit 40 then selects one of the first B type dimming signal VBR-B1 generated by the system unit 40 and the second B type dimming signal VBR-B2 supplied by the control unit 30 as the B type dimming signal VBR-B. The A type dimming signal VBR-A and the B type dimming signal VBR-B are supplied to the inverter unit 50.

Since the DCR enable signal DCR-EN, the first type dimming signal VBR-B1, and the second B type dimming signal VBR-B2 are transmitted between the system unit 40 and the control unit 30, additional transmission lines are required in the first cable CB1. As a result, additional pins are required in the first control connector 34 and the second system connector 42, and a general system unit is not applicable to the driving method for improving contrast ratio. For example, a number of pins of the first control connector 34 for the contrast ratio improvement driving method may be greater than a number of pins of a second system connector of the general system unit. Since at least three pins for the DCR enable signal DCR-EN, the first type dimming signal VBR-B1, and the second B type dimming signal VBR-B2 are required in the second system connector of the general system unit, changes in the pin map of the second system connector is required to accommodate the additional pins.

SUMMARY OF THE INVENTION

Accordingly, the present invention is directed to a driving system for a liquid crystal display device including a liquid crystal panel and a backlight unit that substantially obviates one or more of the problems due to limitations and disadvantages of the related art.

An object of the present invention is to provide a driving system for a liquid crystal display device that improves contrast ratio and reduces power consumption.

Another object of the present invention is to provide a driving system for a liquid crystal display device that transmits dimming signals without changing the pin map of existing circuits.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driving system for a liquid crystal display device includes a system unit to supply image data to be displayed on a liquid crystal panel, the system unit generating a system dimming signal, an inverter unit to control luminance of a backlight unit, the inverter unit receiving the system dimming signal, and a control unit to control display of images on the liquid crystal panel, the control unit receiving the system dimming signal from the inverter unit and outputting a control dimming signal to the inverter unit, wherein the inverter unit adjusts luminance of the backlight unit using the control dimming signal input from the control unit.

In another aspect, a liquid crystal display device includes a liquid crystal panel to display an image, a backlight unit to supply light to the liquid crystal panel, a system unit to supply image data to be displayed on the liquid crystal panel, the system unit generating a system dimming signal, an inverter unit to control luminance of the backlight unit, the inverter unit receiving the system dimming signal, and a control unit to control display of the image on the liquid crystal panel, the control unit receiving the system dimming signal from the inverter unit and outputting a control dimming signal to the inverter unit, wherein the inverter unit adjusts luminance of the backlight unit using the control dimming signal input from the control unit.

In yet another aspect, a method for driving a liquid crystal display device includes generating a system dimming signal by a system unit for supplying image data to be displayed on a liquid crystal panel and outputting the system dimming signal to an inverter unit for controlling luminance of a backlight unit, receiving the system dimming signal and outputting the system dimming signal to a control unit for controlling display of images on the liquid crystal panel, and receiving the system dimming signal from the inverter unit and outputting a control dimming signal to the inverter unit, wherein the inverter unit adjusts a luminance of a backlight unit using the control dimming signal input from the control unit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 10 is a view showing an exemplary analog-to-PWM conversion in a timing controller of the driving system of FIG. 8;

DETAILED DESCRIPTION OF THE EMBODIMENTS

Reference will now be made in detail to the embodiments of the present invention, examples of which are illustrated in the accompanying drawings. Wherever possible, similar reference numbers will be used to refer to the same or similar parts.

Figure 1:
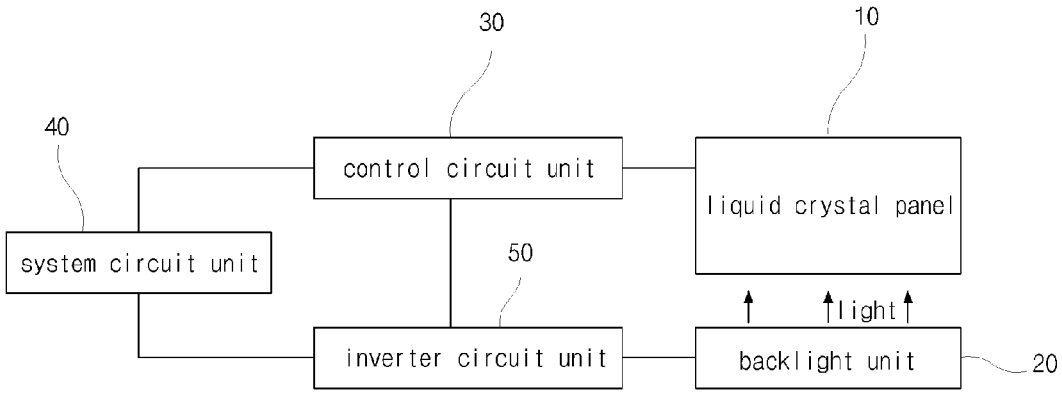
(related art) FIG. 1
FIG. 1 is a view showing a liquid crystal display device according to the related art.
Figure 2:
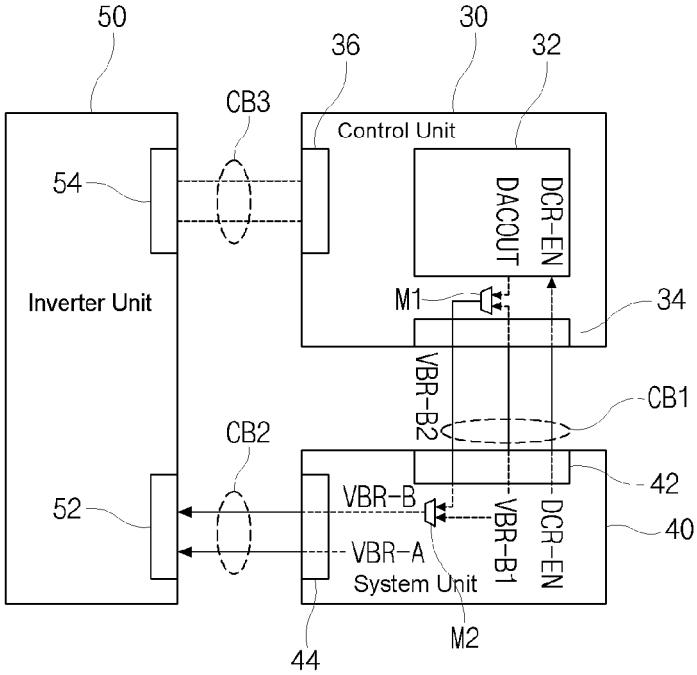
(related art) FIG. 2
FIG. 2 is a view showing a driving system for improving contrast ratio for a liquid crystal display device according to the related art.
Figure 3:
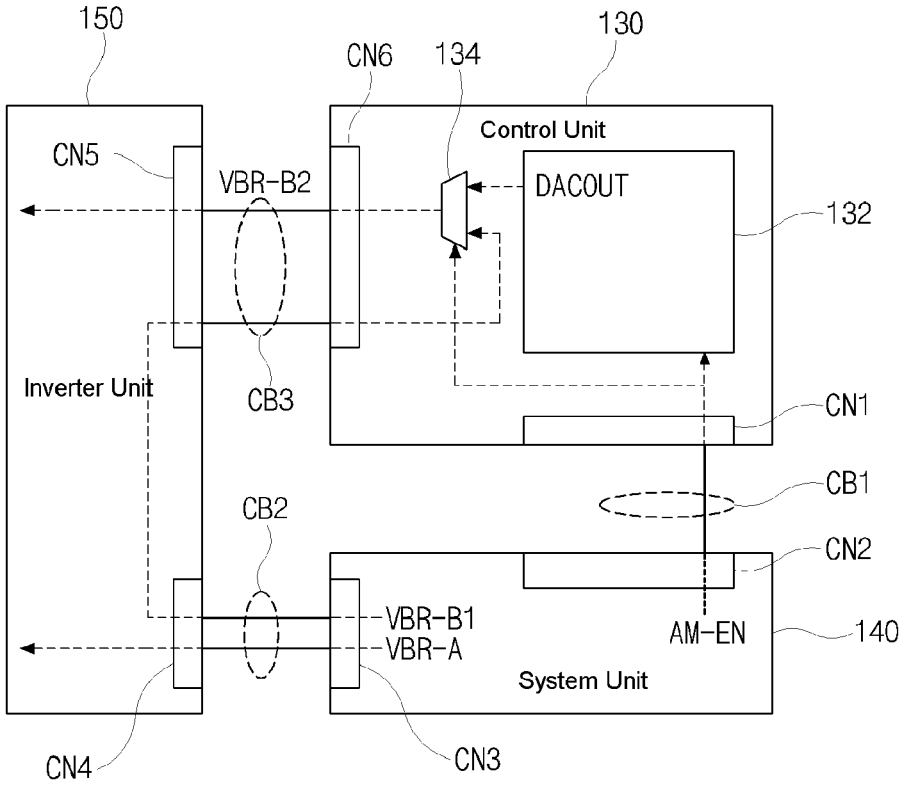
FIG. 3 is a view showing an exemplary driving system for a liquid crystal display device according to a first embodiment of the present invention.

FIG. 3 is a view showing an exemplary driving system for a liquid crystal display device according to a first embodiment of the present invention. In FIG. 3, the driving system of the LCD device includes a control unit 130, a system unit 140, and an inverter unit 150. The LCD device operates in one of a normal mode, in which power consumption is reduced without improvement of contrast ratio, and an advanced mode, in which contrast ratio is improved with reduced power consumption. Although not shown in FIG. 3, the LCD device further includes a liquid crystal panel and a backlight unit coupled with the driving system (e.g., as shown in FIG. 1). The backlight unit coupled with inverter unit 150 supplies light to the liquid crystal panel, and the liquid crystal panel coupled with the control unit 130 displays images.

The control unit 130 is coupled with the system unit 140 through a first cable CB1 connecting a first connector CN1 of the control unit 130 and a second connector CN2 of the system unit 140. The system unit 140 is coupled with the inverter unit 150 through a second cable CB2 connecting a third connector CN3 of the system unit 140 and a fourth connector CN4 of the inverter unit 150. The inverter unit 150 is coupled with the control unit 130 through a third cable CB3 connecting a fifth connector CN5 of the inverter unit 150 and a sixth connector CN6 of the control unit 130. Each of the first to sixth connectors CN1 to CN6 may include at least one transmission line.

The system unit 140 generates an advanced mode enable signal AM-EN according to a user's selection and supplies the advanced mode enable signal AM-EN to the control unit 130 through the first cable CB1. The LCD device may be operated in one of the normal mode and the advanced mode according to the advanced mode enable signal AM-EN. The advanced mode enable signal AM-EN is input to a timing controller 132 and a first multiplexer 134 of the control unit 130. For example, when the advanced mode enable signal AM-EN has a low value (e.g., "0," or disable), the timing controller 132 generates a normal timing controller dimming signal for reducing power consumption without image data conversion for improving contrast ratio, thereby operating the LCD device in the normal mode. When the advanced mode enable signal AM-EN has a high value (e.g., "1," or enable), the timing controller 132 converts the image data and generates an advanced timing controller dimming signal based on the image data conversion, thereby operating the LCD device in the advanced mode.

The system unit 140 may include an external interface circuit, such as a television system and a graphic card, to supply various driving signals such as the image data, a main clock signal, a horizontal synchronization signal, a vertical synchronization signal, and the advanced mode enable signal AM-EN to the control unit 130. In addition, the system unit 140 generates system dimming signals for adjusting lighting period and luminance of the backlight unit. The system dimming signals may be classified into A and B types. The A type dimming signal is an analog DC voltage signal while the B type dimming signal is one of a pulse width modulation (PWM) signal and an analog DC voltage signal. For example, the system unit 140 may generate an A type dimming signal VBR-A and a first B type dimming signal VBR-B1 as the system dimming signal. In addition, the system unit 140 supplies the A type dimming signal VBR-A and the first B type dimming signal VBR-B1 to the inverter unit 150 through the second cable CB2 connecting the third and fourth connectors CN3 and CN4.

The inverter unit 150 transmits the first B type dimming signal VBR-B1 to the control unit 130 through the third cable CB3 connecting the fifth and sixth connectors CN5 and CN6. Accordingly, the first B type dimming signal VBR-B1 is transmitted from the system unit 140 to the control unit 130 through the inverter unit 150 as a bypass with the second and third cables CB2 and CB3 for transmitting the first B type dimming signal VBR-B1. The first B type dimming signal VBR-B1 is input to the first multiplexer 134 of the control unit 130.

The control unit 130 includes the timing controller 132 and the first multiplexer 134. Although not shown in FIG. 3, the timing controller 132 generates a data signal using image data, the main clock signal, the horizontal synchronization signal, and the vertical synchronization signal supplied by the system unit 140 and supplies the data signal to the liquid crystal panel. In addition, the timing controller 132 generates a timing controller dimming signal DACOUT of an analog DC voltage signal corresponding to the data signal. For example, the timing controller dimming signal DACOUT may include one of the normal timing controller dimming signal and the advanced timing controller dimming signal. The first multiplexer 134 selects one of the timing controller dimming signal DACOUT generated by the timing controller 132 and the first B type dimming signal VBR-B1 supplied from the system unit 140 through the inverter unit 150 according to the advanced mode enable signal AM-EN. The control unit 130 supplies the selected signal as a control dimming signal, i.e., a second B type dimming signal VBR-B2, to the inverter unit 150 through the third cable CB3. Although the first multiplexer 134 is shown as being formed independently of the timing controller 132 in FIG. 3, the first multiplexer 134 may be integrated in the timing controller 132 in an alternative embodiment.

The inverter unit 150 adjusts lighting period and luminance of the backlight unit using the A type dimming signal VBR-A supplied by the system unit 140 and the second B type dimming signal VBR-B2 supplied by the control unit 130. When the inverter unit 150 includes a second multiplexer selecting one of the first and second B type dimming signals VBR-B1 and VBR-B2 in an alternative embodiment, the inverter unit 150 may adjust lighting period and luminance of the backlight unit using the A type dimming signal VBR-A and the selected one of the first and second B type dimming signals VBR-B1 and VBR-B2.

Operation of the driving system is described below. The driving system is operated in the normal mode when the advanced mode enable signal AM-EN has a value of "0" by a user's selection. The system unit 140 supplies the advanced mode enable signal AM-EN of "0" to the control unit 130 and supplies the system dimming signals including the A type dimming signal VBR-A and the first B type dimming signal VBR-B1 to the inverter unit 150. The inverter unit 150 transmits the first B type dimming signal VBR-B1 to the control unit 130. The advanced mode enable signal AM-EN of "0" is input to each of the timing controller 132 and the first multiplexer 134, and the first B type dimming signal VBR-B1 is input to the first multiplexer 134. The timing controller 132 generates the normal timing controller dimming signal for reducing power consumption without converting the image data for improving contrast ratio as the timing controller dimming signal DACOUT. The first multiplexer 134 selects one of the timing controller dimming signal DACOUT and the first B type dimming signal VBR-B1 according to the advanced mode enable signal AM-EN of "0" and supplies the selected signal to the inverter unit 150 as the control dimming signal, i.e., the second B type dimming signal VBR-B2. For example, when the advanced mode enable signal AM-EN of "0" is input, the first B type dimming signal VBR-B1 may be selected by the first multiplexer 134 and may be supplied to the inverter unit 150 as the second B type dimming signal VBR-B2. The inverter unit 150 adjusts the lighting period and the luminance of the backlight unit using at least one of the A type dimming signal VBR-A and the second B type dimming signal VBR-B2. As a result, the LCD device including the driving system is operated in the normal mode where the power consumption is reduced by reducing the lighting period of the backlight unit without improving the contrast ratio or converting the image data.

The driving system is operated in the advanced mode when the advanced mode enable signal AM-EN has a value of "1" by a user's selection. The system unit 140 supplies the advanced mode enable signal AM-EN of "1" to the control unit 130 and supplies the system dimming signals including the A type dimming signal VBR-A and the first B type dimming signal VBR-B1 to the inverter unit 150. The inverter unit 150 transmits the first B type dimming signal VBR-B1 to the control unit 130. The advanced mode enable signal AM-EN of "1" is input to each of the timing controller 132 and the first multiplexer 134, and the first B type dimming signal VBR-B1 is input to the first multiplexer 134. The timing controller 132 converts the image data and generates the advanced timing controller dimming signal for reducing power consumption and improving contrast ratio as the timing controller dimming signal DACOUT. The first multiplexer 134 selects one of the timing controller dimming signal DACOUT and the first B type dimming signal VBR-B1 according to the advanced mode enable signal AM-EN of "1" and supplies the selected signal to the inverter unit 150 as the control dimming signal, i.e., the second B type dimming signal VBR-B2. For example, when the advanced mode enable signal AM-EN of "1" is input, the timing controller dimming signal DACOUT may be selected by the first multiplexer 134 and may be supplied to the inverter unit 150 as the second B type dimming signal VBR-B2. The inverter unit 150 adjusts the lighting period and the luminance of the backlight unit using at least one of the A type dimming signal VBR-A and the second B type dimming signal VBR-B2. Since the adjustment of the backlight unit using the second B type dimming signal VBR-B2 has further reduced the lighting period and further reduced the luminance as compared with the adjustment of the backlight unit using the first B type dimming signal VBR-B1, the LCD device including the driving system is operated in the advanced mode where power consumption is reduced and contrast ratio is improved with data conversion.

In the driving system for operating the LCD device in the normal mode and the advanced mode as described above, an additional pin is required in each of the first and second connectors CN1 and CN2 since an additional transmission line is required for transmitting the advanced mode enable signal AM-EN from the system unit 140 to the control unit 130. Therefore, the control unit 130 and the inverter unit 140 of the driving system according to the first embodiment of the present invention may be implemented using a general system unit of an LCD device that operates only in the normal mode (i.e., has an unused dummy pin). The unused dummy pin on the general system unit may be used as the additional pin. Accordingly, the LCD device may be selectively operated in the normal mode and the advanced mode without changing the design of the pin map.

Although the advanced mode enable signal AM-EN is directly transmitted from the system unit 140 to the control unit 130 in the first embodiment in the above description, the advanced mode enable signal AM-EN may also be transmitted from the system unit 140 to the control unit 130 through the inverter unit 150 in an alternative embodiment. For example, the advanced mode enable signal AM-EN may be transmitted from the system unit 140 to the inverter unit 150 through the third connector CN3, the second cable CB2, and the fourth connector CN4. The advanced mode enable signal AM-EN may then be transmitted from the inverter unit 150 to the control unit 130 through the fifth connector CN5, the third cable CB3, and the sixth connector CN6. As a result, no additional transmission line is required in the first cable CB1, and no additional pin is required in each of the first and second connectors CN1 and CN2. Accordingly, the control unit 130 and the inverter unit 140 in the alternative embodiment may be implemented using a general system unit without changing the design of the pin map.

Figure 4:
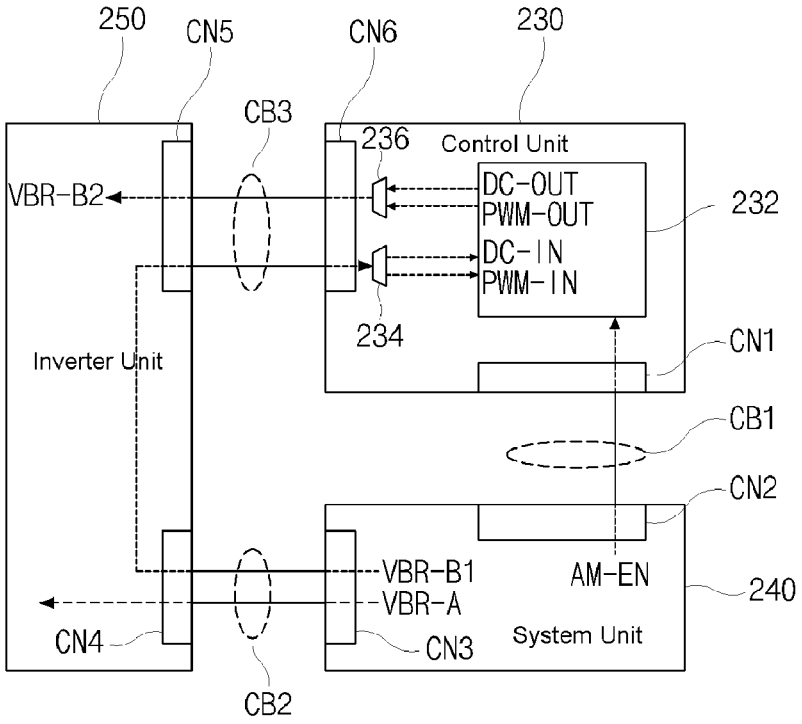
FIG. 4 is a view showing an exemplary driving system for a liquid crystal display device according to a second embodiment of the present invention.
Figure 5:
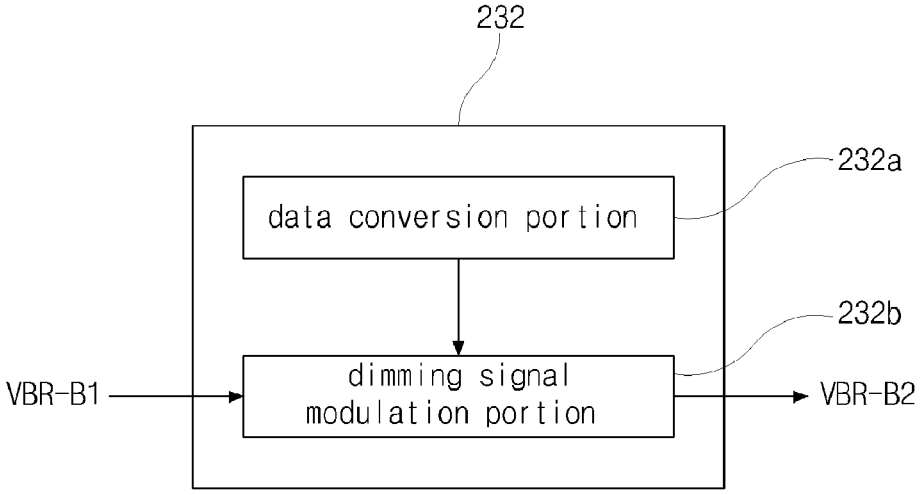
FIG. 5 is a view showing an exemplary timing controller of the driving system of FIG. 4.

FIG. 4 is a view showing an exemplary driving system for a liquid crystal display device according to a second embodiment of the present invention. FIG. 5 is a view showing an exemplary timing controller of the driving system of FIG. 4.

In FIG. 4, the driving system of the LCD device includes a control unit 230, a system unit 240, and an inverter unit 250. The LCD device is operated in one of a normal mode, in which power consumption is reduced without improvement of contrast ratio, and an advanced mode, in which contrast ratio is improved with reduction of power consumption. Although not shown in FIG. 4, the LCD device further includes a liquid crystal panel and a backlight unit coupled with the driving system (e.g., as shown in FIG. 1). The backlight unit coupled with inverter unit 250 supplies light to the liquid crystal panel, and the liquid crystal panel coupled with the control unit 230 displays images.

The control unit 230 is coupled with the system unit 240 through a first cable CB1 connecting a first connector CN1 of the control unit 230 and a second connector CN2 of the system unit 240. The system unit 240 is coupled with the inverter unit 250 through a second cable CB2 connecting a third connector CN3 of the system unit 240 and a fourth connector CN4 of the inverter unit 250. The inverter unit 250 is coupled with the control unit 230 through a third cable CB3 connecting a fifth connector CN5 of the inverter unit 250 and a sixth connector CN6 of the control unit 230. Each of the first to sixth connectors CN1 to CN6 may include at least one transmission line. In addition, each of the third and fourth connectors CN3 and CN4 may include 14 pins and each of the fifth and sixth connectors CN 5 and CN 6 may include one of 4 pins and 6 pins.

The system unit 240 generates an advanced mode enable signal AM-EN according to a user's selection and supplies the advanced mode enable signal AM-EN to the control unit 230 through the first cable CB1. The LCD device may be operated in one of the normal mode and the advanced mode according to the advanced mode enable signal AM-EN. The advanced mode enable signal AM-EN is input to a timing controller 232. For example, when the advanced mode enable signal AM-EN has a low value (e.g., "0," or disable), the timing controller 232 generates a normal control dimming signal for reducing power consumption without image data conversion for improving contrast ratio, thereby operating the LCD device in the normal mode. When the advanced mode enable signal AM-EN has a high value (e.g., "1," or enable), the timing controller 232 converts the image data and generates an advanced control dimming signal based on the image data conversion, thereby operating the LCD device in the advanced mode. The normal control dimming signal and the advanced control dimming signal are transmitted to the inverter unit 250 as the second B type dimming signal VBR-B2 through a second multiplexer 236.

The system unit 240 may include an external interface circuit, such as a television system and a graphic card, to supply various driving signals such as image data, a main clock signal, a horizontal synchronization signal, a vertical synchronization signal, and the advanced mode enable signal AM-EN to the control unit 230. In addition, the system unit 240 generates system dimming signals for adjusting lighting period and illumination of the backlight unit. The system dimming signals may be classified into A and B types. The A type dimming signal is an analog DC voltage signal while the B type dimming signal is one of a PWM signal and an analog DC voltage signal. For example, the system unit 240 may generate an A type dimming signal VBR-A and a first B type dimming signal VBR-B1 as the system dimming signal. In addition, the system unit 240 supplies the A type dimming signal VBR-A and the first B type dimming signal VBR-B1 to the inverter unit 250 through the second cable CB2 connecting the third and fourth connectors CN3 and CN4.

The inverter unit 250 transmits the first B type dimming signal VBR-B1 to the control unit 230 through the third cable CB3 connecting the fifth and sixth connectors CN5 and CN6. Accordingly, the first B type dimming signal VBR-B1 is transmitted from the system unit 240 to the control unit 230 through the inverter unit 250 as a bypass with the second and third cables CB2 and CB3 for transmitting the first B type dimming signal VBR-B1. The first B type dimming signal VBR-B1 is input to a first multiplexer 234 of the control unit 230.

The control unit 230 includes the timing controller 232, the first multiplexer 234, and the second multiplexer 236. The timing controller 232 may include an integrated circuit (IC), and each of the first and second multiplexers 234 and 236 may include a resistor. Although the first and second multiplexers 234 and 236 are shown as being independently of the timing controller 232 in FIG. 4, the first and second multiplexers 234 and 236 may be integrated in the timing controller 232 in an alternative embodiment. In addition, although not shown in FIG. 4, the timing controller 232 generates a data signal using the image data, the main clock signal, the horizontal synchronization signal, and the vertical synchronization signal supplied by the system unit 240 and supplies the data signal to the liquid crystal panel.

Further, as shown in FIG. 5, the timing controller 232 includes a data conversion portion 232*a* and a dimming signal modulation portion 232*b*. The first B type dimming signal VBR-B1 is input to the dimming signal modulation portion 232*b* through the first multiplexer 234, and a second B type dimming signal VBR-B2 is output from the dimming signal modulation portion 232*b* through the second multiplexer 236. The dimming signal modulation portion 232*b* modulates the first B type dimming signal VBR-B2 on the basis of a conversion status signal of the data conversion portion to generate the second B type dimming signal VBR-B2. The second B type dimming signal VBR-B2, i.e., the control dimming signal, is transmitted to the inverter unit 250 through the third cable CB3.

When the advanced mode enable signal AM-EN of "0" is input to the timing controller 232, the data conversion portion 232*a* does not convert gray levels of the image data and a conversion status signal corresponding to the image data having no data conversion is output from the data conversion portion 232*a*. Accordingly, data signals corresponding to the image data are supplied to the liquid crystal panel without conversion (e.g., no data stretching). The dimming signal modulation portion 232*b* may just output the first B type dimming signal VBR-B1 as the second B type dimming signal VBR-B2 on the basis of the conversion status signal corresponding to the image data having no data conversion. Alternatively, the dimming signal modulation portion 232*b* may modulate the first B type dimming signal VBR-B1 to be synchronized with the data signals and may output the modulated first B type dimming signal VBR-B1 as the second B type dimming signal VBR-B2 on the basis of the conversion status signal corresponding to the image data having no data conversion in an alternative embodiment.

When the advanced mode enable signal AM-EN of "1" is input to the timing controller 232, the data conversion portion 232*a* converts gray levels of the image data (e.g., data stretching), and the data signal corresponding to the converted image data is supplied to the liquid crystal panel. In addition, the conversion status signal corresponding to the image data having data conversion is transmitted from the data conversion portion 232*a* to the dimming signal modulation portion 232*b*. The dimming signal modulation portion 232*b* modulates the first B type dimming signal VBR-B1 on the basis of the conversion status signal corresponding to the image data having data conversion to output the second B type dimming signal VBR-B2. The second B type dimming signal VBR-B2 is synchronized with the data signal.

The first and second B type dimming signals VBR-B1 and VBR-B2, respectively may be one of a PWM signal and an analog DC voltage signal. By selection of the first multiplexer 234, the first B type dimming signal VBR-B1 of the PWM signal is input to a PWM input terminal PWM-IN of the timing controller 232, and the first B type dimming signal VBR-B1 of the analog DC signal is input to a DC input terminal DC-IN of the timing controller 232. In addition, by selection of the second multiplexer 236, the second B type dimming signal VBR-B2 of the PWM signal is output from a PWM output terminal PWM-OUT of the timing controller 232, and the second B type dimming signal VBR-B2 of the analog DC signal is output from a DC output terminal DC-OUT of the timing controller 232. Accordingly, the first multiplexer 234 determines the input terminal of the timing controller 232 for the first B type dimming signal VBR-B1, and the second multiplexer 236 determines the output terminal of the timing controller 232 for the second B type dimming signal VBR-B2. The inverter unit 250 adjusts the lighting period and the luminance of the backlight unit using the A type dimming signal VBR-A supplied by the system unit 240 and the second B type dimming signal VBR-B2 supplied by the control unit 230.

Operation of the driving system is described below. The driving system is operated in the normal mode when the advanced mode enable signal AM-EN has a value of "0" by a user's selection. The system unit 240 supplies the advanced mode enable signal AM-EN of "0" to the timing controller 232 of the control unit 230 and supplies the system dimming signals including the A type dimming signal VBR-A and the first B type dimming signal VBR-B1 to the inverter unit 250. The inverter unit 250 transmits the first B type dimming signal VBR-B1 to the timing controller 232 of the control unit 230 through the first multiplexer 234. The timing controller 232 just outputs the first B type dimming signal VBR-B1 as the second B type dimming signal VBR-B2. Alternatively, the timing controller 232 may modulate the first B type dimming signal VBR-B1 to be synchronized with the data signal and may output the modulated first B type dimming signal VBR-B1 as the second B type dimming signal VBR-B2. The second B type dimming signal VBR-B2 is input to the inverter unit 250 through the second multiplexer 246, and the inverter unit 250 adjusts the lighting period and the luminance of the backlight unit using at least one of the A type dimming signal VBR-A and the second B type dimming signal VBR-B2. As a result, the LCD device including the driving system is operated in the normal mode where the power consumption is reduced by reducing the lighting period of the backlight unit without improving the contrast ratio or converting the image data.

The driving system is operated in the advanced mode when the advanced mode enable signal AM-EN has a value of "1" by a user's selection. The system unit 240 supplies the advanced mode enable signal AM-EN of "1" to the timing controller 232 of the control unit 230 and supplies the system dimming signals including the A type dimming signal VBR-A and the first B type dimming signal VBR-B1 to the inverter unit 250. The inverter unit 250 transmits the first B type dimming signal VBR-B1 to the timing controller 232 of the control unit 230 through the first multiplexer 234. The timing controller 232 converts the image data and outputs the conversion status signal corresponding to the image data having data conversion for reducing power consumption and improving contrast ratio. Further, the timing controller 232 modulates the first B type dimming signal VBR-B1 on the basis of the conversion status signal corresponding to the image data having data conversion to output the second B type dimming signal VBR-B2 for reducing power consumption and improving contrast ratio. The second B type dimming signal VBR-B2 is input to the inverter unit 250 through the second multiplexer 246, and the inverter unit 250 adjusts the lighting period and the luminance of the backlight unit using at least one of the A type dimming signal VBR-A and the second B type dimming signal VBR-B2. Since the adjustment of the backlight unit using the second B type dimming signal VBR-B2 has further reduced the lighting period and further reduced the luminance as compared with the adjustment of the backlight unit using the first B type dimming signal VBR-B1, the LCD device including the driving system is operated in the advanced mode where power consumption is reduced and contrast ratio is improved with data conversion.

In the driving system for operating the LCD device in the normal mode and the advanced mode as described above, an additional pin is required in each of the first and second connectors CN1 and CN2 since an additional transmission line is required for transmitting the advanced mode enable signal AM-EN from the system unit 240 to the control unit 230. Therefore, the control unit 230 and the inverter unit 240 of the driving system according to the second embodiment of the present invention may be implemented using a general system unit of an LCD device that operates only in the normal mode (i.e., has an unused dummy pin). The unused dummy pin on the general system unit may be used as the additional pin. Accordingly, the LCD device may be selectively operated in the normal mode and the advanced mode without changing the design of the pin map.

Although the advanced mode enable signal AM-EN is directly transmitted from the system unit 240 to the control unit 230 in the second embodiment, the advanced mode enable signal AM-EN may be transmitted from the system unit 240 to the control unit 230 through the inverter unit 250 in an alternative embodiment. For example, the advanced mode enable signal AM-EN may be transmitted from the system unit 240 to the inverter unit 250 through the third connector CN3, the second cable CB2, and the fourth connector CN4. The advanced mode enable signal AM-EN may then be transmitted from the inverter unit 250 to the control unit 230 through the fifth connector CN5, the third cable CB3, and the sixth connector CN6. As a result, no additional transmission line is required in the first cable CB1, and no additional pin is required in each of the first and second connectors CN1 and CN2. Accordingly, the control unit 230 and the inverter unit 240 in the alternative embodiment may be implemented using a general system unit without changing the design of the pin map.

Figure 6:
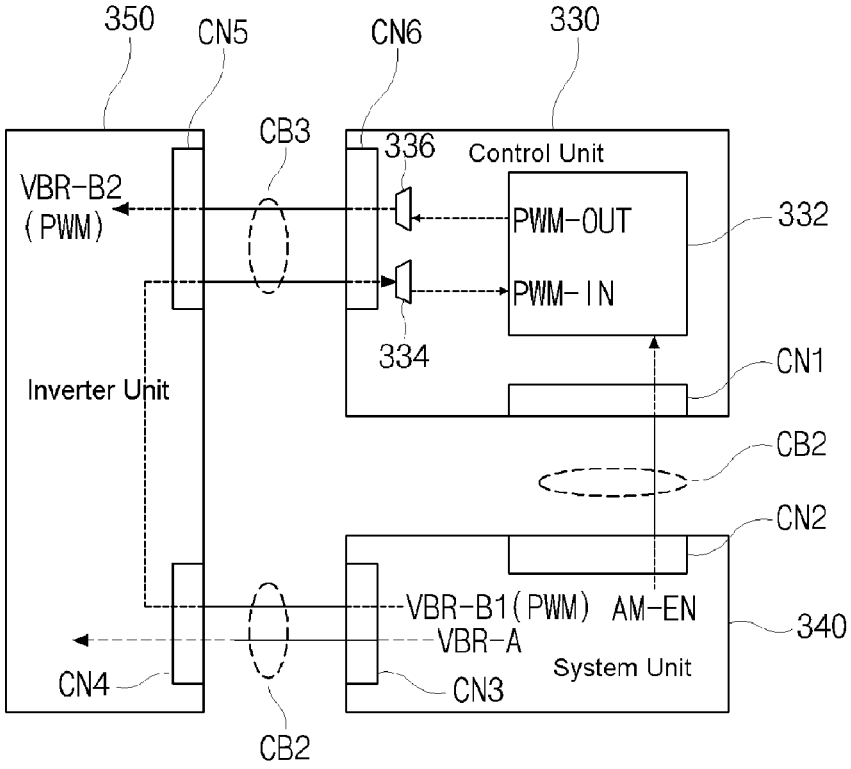
FIG. 6 is a view showing an exemplary driving system for a liquid crystal display device according to a third embodiment of the present invention.
Figure 7:
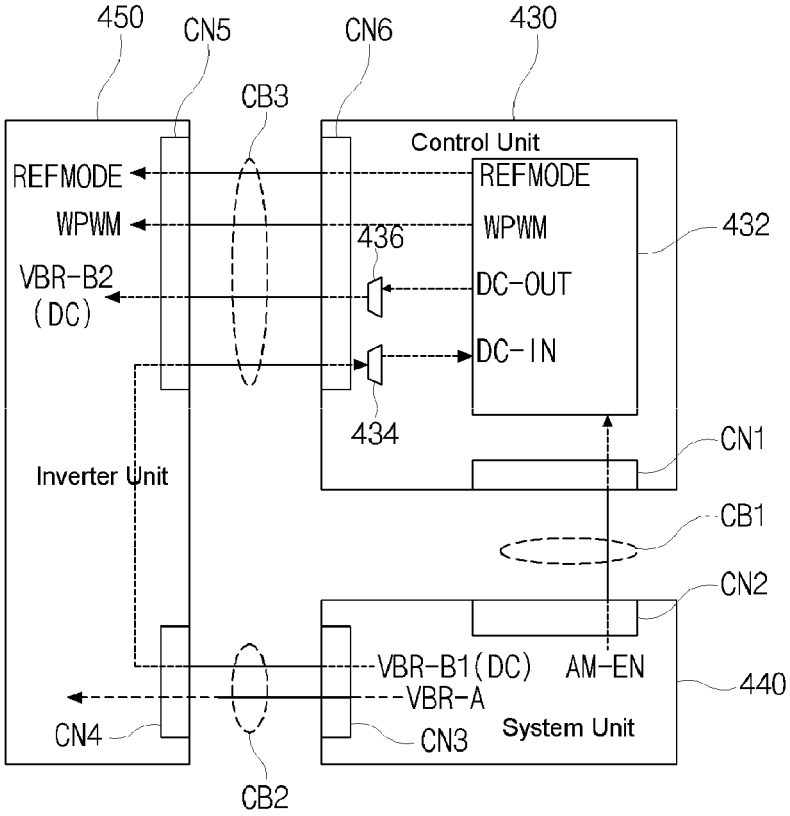
FIG. 7 is a view showing an exemplary driving system for a liquid crystal display device according to a fourth embodiment of the present invention.

FIGS. 6 and 7 are views showing exemplary driving systems for a liquid crystal display device according to third and fourth embodiments of the present invention, respectively. Each driving system of FIGS. 6 and 7 has a similar structure with the driving system of FIG. 4. Accordingly, illustrations and descriptions about the same parts are not repeated. Further, a PWM signal and an analog DC voltage signal are used as a first B type dimming signal in FIGS. 6 and 7, respectively.

In FIG. 6, the driving system of the LCD device includes a control unit 330, a system unit 340, and an inverter unit 350. The LCD device is operated in one of a normal mode, in which power consumption is reduced without improvement of contrast ratio, and an advanced mode, in which contrast ratio is improved with reduction of power consumption. Since the system unit 340 outputs a first B type dimming signal VBR-B1 of a PWM signal, a first and second multiplexers 334 and 336, respectively, are controlled to select a PWM input terminal PWM-IN and a PWM output terminal PWM-OUT as the terminals of a timing controller 332.

The system unit 340 generates an advanced mode enable signal AM-EN according to a user's selection and supplies the advanced mode enable signal AM-EN to the control unit 330 through the first cable CB1. The LCD device may be operated in one of the normal mode and the advanced mode according to the advanced mode enable signal AM-EN. The advanced mode enable signal AM-EN is input to a timing controller 332. For example, when the advanced mode enable signal AM-EN has a low value (e.g., "0," or disable), the timing controller 332 generates a normal control dimming signal for reducing power consumption without image data conversion for improving contrast ratio, thereby operating the LCD device in the normal mode. When the advanced mode enable signal AM-EN has a high value (e.g., "1," or enable), the timing controller 332 may convert the image data and generate an advanced control dimming signal based on the image data conversion, thereby operating the LCD device in the advanced mode.

The system unit 340 may include an external interface circuit, such as a television system and a graphic card, to supply various driving signals such as image data, a main clock signal, a horizontal synchronization signal, a vertical synchronization signal, and the advanced mode enable signal AM-EN to the control unit 330. In addition, the system unit 340 generates system dimming signals for adjusting lighting period and illumination of the backlight unit. For example, the system unit 340 may generate an A type dimming signal VBR-A of an analog DC voltage signal and a first B type dimming signal VBR-B1 of a PWM signal as the system dimming signals. In addition, the system unit 340 supplies the A type dimming signal VBR-A and the first B type dimming signal VBR-B1 to the inverter unit 350 through the second cable CB2.

The inverter unit 350 transmits the first B type dimming signal VBR-B1 to the control unit 330 through the third cable CB3. Accordingly, the first B type dimming signal VBR-B1 is transmitted from the system unit 340 to the control unit 330 through the inverter unit 350 as a bypass with the second and third cables CB2 and CB3 for transmitting the first B type dimming signal VBR-B1. The first B type dimming signal VBR-B1 is input to a first multiplexer 334 of the control unit 330.

The control unit 330 includes the timing controller 332, the first multiplexer 334, and a second multiplexer 336. The timing controller 332 may include an integrated circuit (IC), and each of the first and second multiplexers 334 and 336 may include a resistor. Although not shown in FIG. 6, the timing controller 332 includes a data conversion portion and a dimming signal modulation portion (e.g., as shown in FIG. 5). The first B type dimming signal VBR-B1 is input to the PWM input terminal PWM-IN of the timing controller 332 by the first multiplexer 334. A second B type dimming signal VBR-B2 is output from the PWM output terminal PWM-OUT of the timing controller 332 by the second multiplexer 336 and is transmitted to the inverter unit 350 through the third cable CB3.

When the advanced mode enable signal AM-EN of "0" is input to the timing controller 332, the timing controller 332 does not convert gray levels of the image data and generates a conversion status signal corresponding to the image data having no data conversion. Accordingly, data signals corresponding to the image data are supplied to the liquid crystal panel without conversion (e.g., no data stretching). The timing controller 332 may just output the first B type dimming signal VBR-B1 as the second B type dimming signal VBR-B2 on the basis of the conversion status signal corresponding to the image data having no data conversion. Alternatively, the timing controller 332 may modulate the first B type dimming signal VBR-B1 to be synchronized with the data signal and may output the modulated first B type dimming signal VBR-B1 as the second B type dimming signal VBR-B2 on the basis of the conversion status signal corresponding to the image data having no data conversion in an alternative embodiment.

When the advanced mode enable signal AM-EN of "1" is input to the timing controller 332, the timing controller 332 converts gray levels of the image data (e.g., data stretching), and the data signal corresponding to the converted image data is supplied to the liquid crystal panel. In addition, the timing controller 332 generates a conversion status signal corresponding to the image data having data conversion modulates the first B type dimming signal VBR-B1 on the basis of the conversion status signal corresponding to the image data having data conversion to output the second B type dimming signal VBR-B2. The second B type dimming signal VBR-B2 is synchronized with the data signal.

The inverter unit 350 adjusts the lighting period and the luminance of the backlight unit using the A type dimming signal VBR-A supplied by the system unit 340 and the second B type dimming signal VBR-B2 supplied by the control unit 330. As a result, the LCD device including the driving system is operated in one of the normal mode where the power consumption is reduced without improvement in contrast ratio and the advanced mode where power consumption is reduced and contrast ratio is improved.

In FIG. 7, the driving system of the LCD device includes a control unit 430, a system unit 440, and an inverter unit 450. The LCD device is operated in one of a normal mode, in which power consumption is reduced without improvement of contrast ratio, and an advanced mode, in which contrast ratio is improved with reduction of power consumption. Since the system unit 440 outputs a first B type dimming signal VBR-B1 of a PWM signal, a first and second multiplexers 434 and 436, respectively, are controlled to select a DC input terminal DC-IN and a DC output terminal DC-OUT as the terminals of a timing controller 432.

The system unit 440 generates an advanced mode enable signal AM-EN according to a user's selection and supplies the advanced mode enable signal AM-EN to the control unit 430 through the first cable CB1. The LCD device may be operated in one of the normal mode and the advanced mode according to the advanced mode enable signal AM-EN. The advanced mode enable signal AM-EN is input to a timing controller 432. For example, when the advanced mode enable signal AM-EN has a low value (e.g., "0," or disable), the timing controller 432 generates a normal control dimming signal for reducing power consumption without image data conversion for improving contrast ratio, thereby operating the LCD device in the normal mode. When the advanced mode enable signal AM-EN has a high value (e.g., "1," or enable), the timing controller 432 converts the image data and generates an advanced control dimming signal based on the image data conversion, thereby operating the LCD device in the advanced mode.

The system unit 440 may include an external interface circuit, such as a television system and a graphic card, to supply various driving signals such as image data, a main clock signal, a horizontal synchronization signal, a vertical synchronization signal, and the advanced mode enable signal AM-EN to the control unit 430. In addition, the system unit 440 generates system dimming signals for adjusting lighting period and illumination of the backlight unit. For example, the system unit 440 may generate an A type dimming signal VBR-A of an analog DC voltage signal and a first B type dimming signal VBR-B1 of an analog DC voltage signal as the system dimming signals. In addition, the system unit 440 supplies the A type dimming signal VBR-A and the first B type dimming signal VBR-B1 to the inverter unit 450 through the second cable CB2.

The inverter unit 450 transmits the first B type dimming signal VBR-B1 to the control unit 430 through the third cable CB3. Accordingly, the first B type dimming signal VBR-B1 is transmitted from the system unit 440 to the control unit 430 through the inverter unit 450 as a bypass with the second and third cables CB2 and CB3 for transmitting the first B type dimming signal VBR-B1. The first B type dimming signal VBR-B1 is input to a first multiplexer 434 of the control unit 430.

The control unit 430 includes the timing controller 432, the first multiplexer 434, and a second multiplexer 436. The timing controller 432 may include an integrated circuit (IC), and each of the first and second multiplexers 434 and 436 may include a resistor. Although not shown in FIG. 7, the timing controller 432 includes a data conversion portion and a dimming signal modulation portion (e.g., as shown in FIG. 5). The first B type dimming signal VBR-B1 is input to the DC input terminal DC-IN of the timing controller 432 by the first multiplexer 434. A second B type dimming signal VBR-B2 is output from the DC output terminal DC-OUT of the timing controller 432 by the second multiplexer 436 and is transmitted to the inverter unit 450 through the third cable CB3.

The timing controller 432 further includes a mode output terminal REFMODE and a synchronization output terminal WPWM. A mode signal corresponding to a display type, such as National Television System Committee (NTSC) and Phase Alternating Line (PAL), is output from the mode output terminal REFMODE and a synchronization signal corresponding to the data signal is output from the synchronization output terminal WPWM.

When the advanced mode enable signal AM-EN of "0" is input to the timing controller 432, the timing controller 432 does not convert gray levels of the image data generates a conversion status signal corresponding to the image data having no data conversion. Accordingly, data signals corresponding to the image data are supplied to the liquid crystal panel without conversion (e.g., no data stretching). The timing controller 432 may just output the first B type dimming signal VBR-B1 as the second B type dimming signal VBR-B2 on the basis of the conversion status signal corresponding to the image data having no data conversion. Alternatively, the timing controller 432 may modulate the first B type dimming signal VBR-B1 to be synchronized with the data signal and may output the modulated first B type dimming signal VBR-B1 as the second B type dimming signal VBR-B2 on the basis of the conversion status signal corresponding to the image data having no data conversion in an alternative embodiment.

When the advanced mode enable signal AM-EN of "1" is input to the timing controller 432, the timing controller 432 converts gray levels of the image data (e.g., data stretching), and the data signal corresponding to the converted image data is supplied to the liquid crystal panel. In addition, the timing controller 432 generates a conversion status signal corresponding to the image data having data conversion and modulates the first B type dimming signal VBR-B1 on the basis of the the image data having conversion status signal corresponding to the image data having data conversion to output the second B type dimming signal VBR-B2. The second B type dimming signal VBR-B2 is synchronized with the data signal.

The inverter unit 450 adjusts the lighting period and the luminance of the backlight unit using the A type dimming signal VBR-A supplied by the system unit 440 and the second B type dimming signal VBR-B2 supplied by the control unit 430. As a result, the LCD device including the driving system is operated in one of the normal mode where the power consumption is reduced without improvement in contrast ratio and the advanced mode where power consumption is reduced and contrast ratio is improved.

In the driving system of each of FIGS. 6 and 7 for operating the LCD device in the normal mode and the advanced mode as described above, since an additional transmission line is required for transmitting the advanced mode enable signal AM-EN from the system unit 340 or 440 to the control unit 330 or 430, an additional pin is required in each of the first and second connectors CN1 and CN2. As a result, the control unit 330 or 430 and the inverter unit 340 or 440 of the driving system according to each of the third and fourth embodiments of the present invention are applicable to a general system unit of an LCD device that is operated only in the normal mode without a design change of pin map by utilizing a dummy pin for the additional pin. Accordingly, the LCD device may be selectively operated in the normal mode and the advanced mode.

Although the advanced mode enable signal AM-EN is directly transmitted from the system unit 340 or 440 to the control unit 330 or 430 in each of the third and fourth embodiments, the advanced mode enable signal AM-EN may be transmitted from the system unit 340 or 440 to the control unit 330 or 430 through the inverter unit 350 or 450 in an alternative embodiment. For example, the advanced mode enable signal AM-EN may be transmitted from the system unit 340 or 440 to the inverter unit 350 or 450 through the third connector CN3, the second cable CB2, and the fourth connector CN4. The advanced mode enable signal AM-EN may then be transmitted from the inverter unit 350 or 450 to the control unit 330 or 430 through the fifth connector CN5, the third cable CB3, and the sixth connector CN6. As a result, no additional transmission line is required in the first cable CB1, and no additional pin is required in each of the first and second connectors CN1 and CN2. Accordingly, the control unit 330 or 430 and the inverter unit 340 or 440 in the alternative embodiment may be implemented using a general system unit without changing the design of the pin map.

Figure 8:
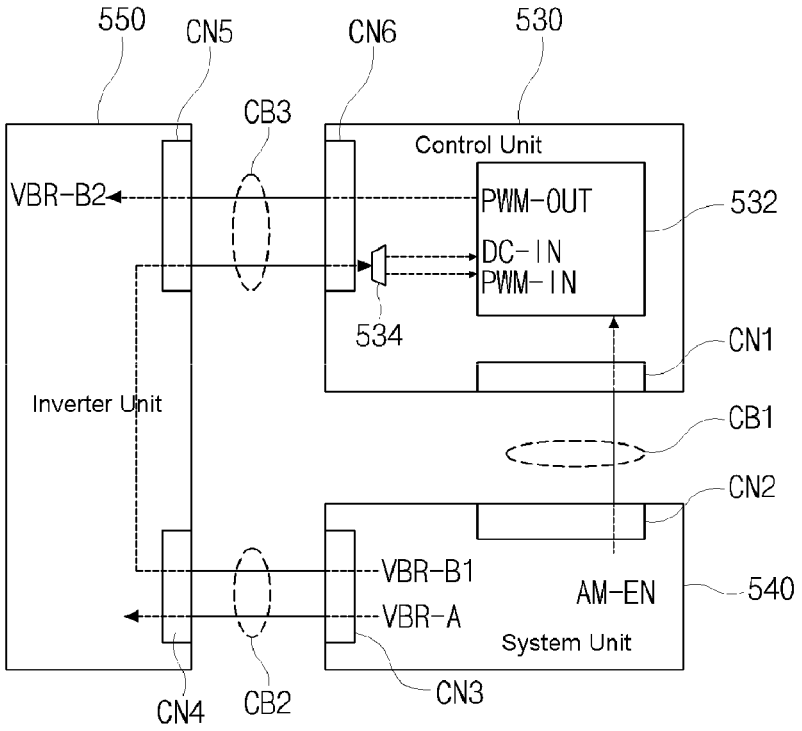
FIG. 8 is a view showing an exemplary driving system for a liquid crystal display device according to a fifth embodiment of the present invention.
Figure 9:
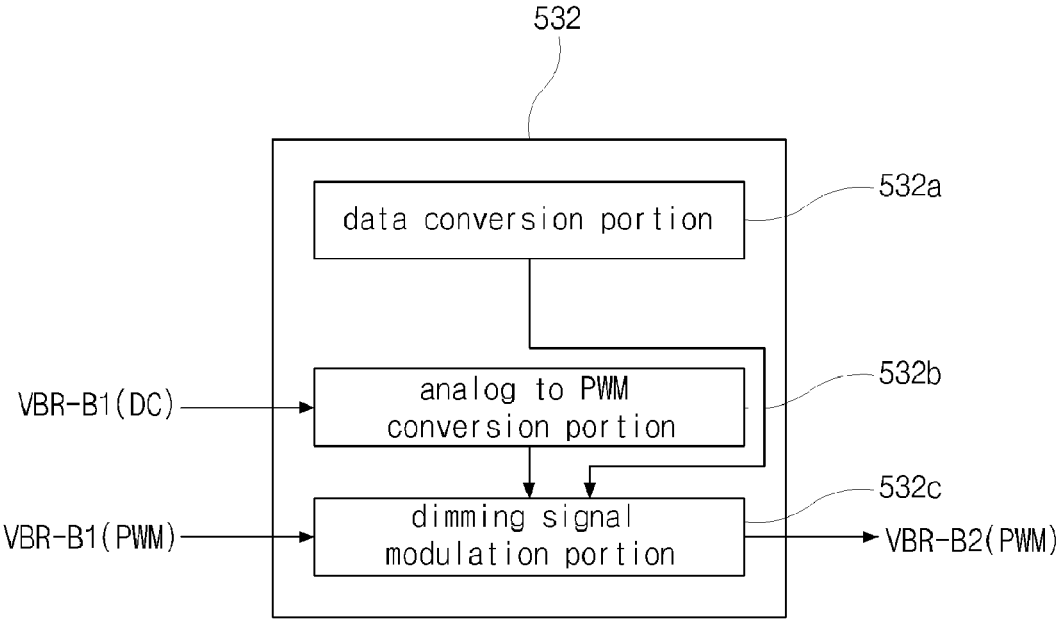
FIG. 9 is a view showing an exemplary timing controller of the driving system of FIG. 8.

FIG. 8 is a view showing an exemplary driving system for a liquid crystal display device according to a fifth embodiment of the present invention. FIG. 9 is a view showing an exemplary timing controller of the driving system of FIG. 8. FIG. 10 is a view showing an exemplary analog-to-PWM conversion in a timing controller of the driving system of FIG. 8. The driving system of FIG. 8 has similar structure with the driving system of FIG. 4. Accordingly, illustrations and descriptions about the same parts are not repeated.

In FIG. 8, the driving system of the LCD device includes a control unit 530, a system unit 540, and an inverter unit 550. The LCD device is operated in one of a normal mode, in which power consumption is reduced without improvement of contrast ratio, and an advanced mode, in which contrast ratio is improved with reduction of power consumption. The control unit 530 is coupled with the system unit 540 through a first cable CB1, and the system unit 540 is coupled with the inverter unit 550 through a second cable CB2. The inverter unit 550 is coupled with the control unit 530 through a third cable CB3. Each of the first to sixth connectors CN1 to CN6 may include at least one transmission line. Further, each of the third and fourth connectors CN3 and CN4 may include 14 pins and each of the fifth and sixth connectors CN5 and CN 6 may include 4 pins.

The system unit 540 generates an advanced mode enable signal AM-EN according to a user's selection and supplies the advanced mode enable signal AM-EN to the control unit 530 through the first cable CB1. The LCD device may be operated in one of the normal mode and the advanced mode according to the advanced mode enable signal AM-EN. The advanced mode enable signal AM-EN is input to a timing controller 532. For example, when the advanced mode enable signal AM-EN has a low value (e.g., "0," or disable), the timing controller 532 generates a normal control dimming signal for reducing power consumption without image data conversion for improving contrast ratio, thereby operating the LCD device in the normal mode. When the advanced mode enable signal AM-EN has a high value (e.g., "1," or enable), the timing controller 532 converts the image data and generates an advanced control dimming signal based on the image data conversion, thereby operating the LCD device in the advanced mode. The normal control dimming signal and the advanced control dimming signal are transmitted to the inverter unit 550 as the second B type dimming signal VBR-B2.

The system unit 540 may include an external interface circuit, such as a television system and a graphic card, to supply various driving signals such as image data, a main clock signal, a horizontal synchronization signal, a vertical synchronization signal, and the advanced mode enable signal AM-EN to the control unit 530. In addition, the system unit 540 generates system dimming signals for adjusting lighting period and illumination of the backlight unit. For example, the system unit 540 may generate an A type dimming signal VBR-A and a first B type dimming signal VBR-B1 as the system dimming signal. In addition, the system unit 540 supplies the A type dimming signal VBR-A and the first B type dimming signal VBR-B1 to the inverter unit 550 through the second cable CB2.

The inverter unit 550 transmits the first B type dimming signal VBR-B1 to the control unit 530 through the third cable CB3. Accordingly, the first B type dimming signal VBR-B1 is transmitted from the system unit 540 to the control unit 530 through the inverter unit 550 as a bypass with the second and third cables CB2 and CB3 for transmitting the first B type dimming signal VBR-B1. The first B type dimming signal VBR-B1 is input to a first multiplexer 534 of the control unit 530.

The control unit 530 includes the timing controller 532 and the first multiplexer 534. The timing controller 532 may include an integrated circuit (IC), and the first and multiplexer 534 may include a resistor. Although the first multiplexer 534 is shown as being formed independently of the timing controller 532 in FIG. 8, the first multiplexer 534 may be integrated in the timing controller 532 in an alternative embodiment. In addition, although not shown in FIG. 8, the timing controller 532 generates a data signal using the image data, the main clock signal, the horizontal synchronization signal, and the vertical synchronization signal supplied by the system unit 540 and supplies the data signal to the liquid crystal panel.

Further, as shown in FIG. 9, the timing controller 532 includes a data conversion portion 532*a*, an analog-to-PWM conversion portion 532*b*, and a dimming signal modulation portion 532*c*. The first B type dimming signal VBR-B1 transmitted to the control unit 530 through the inverter unit 550 has one of a PWM signal and an analog DC voltage signal. The first B type dimming signal VBR-B1 of a PWM signal is input to the dimming signal modulation portion 532*c* through the first multiplexer 534, and the first B type dimming signal VBR-B1 of an analog DC voltage is input to the analog-to-PWM conversion portion 532*b* through the first multiplexer 534. The dimming signal modulation portion 532*c* receives the first B type dimming signal VBR-B1 of a PWM signal from the system unit 540 and the first B type dimming signal VBR-B1 of a converted PWM signal from the analog-to-PWM portion 532*b*. In addition, a second B type dimming signal VBR-B2 is output from the dimming signal modulation portion 532*c*. The second B type dimming signal VBR-B2 is transmitted to the inverter unit 550 through the third cable CB3.

When the first B type dimming signal VBR-B1 is an analog DC voltage signal, the analog-to-PWM conversion portion 532*b* converts the analog DC voltage signal to a digital signal and then converts the digital signal to a converted PWM signal having a high width ratio corresponding to a voltage level of the analog DC voltage signal. The analog DC voltage signal may be converted to the digital signal using an analog to digital converter (ADC). As shown in FIG. 10, when the analog DC voltage signal has a voltage level within a range of about 0.0V to about 3.3V, the converted PWM signal may have a high width ratio within a range of about 30% to about 100%. For example, the analog DC voltage signal may be converted to the converted PWM signal such that the minimum and maximum voltage levels, i.e., about 0.0V and about 3.3V, correspond to the high width ratios of about 30% and about 100%, respectively. In addition, FIG. 10 shows exemplary waveforms of the converted PWM signals having various high width ratios. The correspondence between the voltage level and the high width ratio may be determined differently in alternative embodiments.

Since the first B type dimming signal of the converted PWM signal of the analog-to-PWM conversion portion 532*b* or the first B type dimming signal VBR-B1 of the PWM signal of the system unit 540 is transmitted to the dimming signal modulation portion 532*c*, the dimming signal modulation portion 532*c* receives a PWM signal regardless of the kind of the B type dimming signal in the system unit 540, i.e., whether the first B type dimming signal is a PWM signal or an analog DC voltage signal. That is, the second B type dimming signal VBR-B2 output from the dimming signal modulation portion 532*c* is a PWM signal when the first B type dimming signal VBR-B1 is a PWM signal or when the first B type dimming signal VBR-B1 is an analog DC voltage signal.

When the advanced mode enable signal AM-EN of "0" is input to the timing controller 532, the data conversion portion 532*a* does not convert gray levels of the image data and generates a conversion status signal corresponding to the image data having no data conversion. Accordingly, data signals corresponding to the image data are supplied to the liquid crystal panel without conversion (e.g., no data stretching). In addition, the analog-to-PWM conversion portion 532*b* converts the first B type dimming signal VBR-B1 of an analog DC voltage signal into a converted PWM signal as the first B type dimming signal VBR-B1, and the first B type dimming signal VBR-B1 of the converted PWM signal is transmitted to the dimming signal modulation portion 532*c*. The dimming signal modulation portion 532*c* receives the first B type dimming signal VBR-B1 of the converted PWM signal from the analog-to-PWM conversion portion 532*b* or the first B type dimming signal VBR-B1 of a PWM signal from the system unit 540. In addition, the dimming signal modulation portion 532*c* may just output the first B type dimming signal VBR-B1 as the second B type dimming signal VBR-B2 on the basis of the conversion status signal corresponding to the image data having no data conversion. Alternatively, the dimming signal modulation portion 532*c* may modulate the first B type dimming signal VBR-B1 to be synchronized with the data signal and may output the modulated first B type dimming signal VBR-B1 as the second B type dimming signal VBR-B2 on the basis of the conversion status signal corresponding to the image data having no data conversion in an alternative embodiment.

When the advanced mode enable signal AM-EN of "1" is input to the timing controller 532, the data conversion portion 532*a* converts gray levels of the image data (e.g., data stretching), and the data signal corresponding to the converted image data is supplied to the liquid crystal panel. In addition, the conversion status signal corresponding to the image data having data conversion is transmitted from the data conversion portion 532*a* to the dimming signal modulation portion 532*c*. The analog-to-PWM conversion portion 532*b* converts the first B type dimming signal VBR-B1 of an analog DC voltage signal into a converted PWM signal as the first B type dimming signal VBR-B1, and the first B type dimming signal VBR-B1 of the converted PWM signal is transmitted to the dimming signal modulation portion 532*c*. The dimming signal modulation portion 532*c* receives the first B type dimming signal VBR-B1 of the converted PWM signal from the analog-to-PWM conversion portion 532*b* or the first B type dimming signal VBR-B1 of a PWM signal from the system unit 540. In addition, the dimming signal modulation portion 532*c* modulates the first B type dimming signal VBR-B1 on the basis of the conversion status signal corresponding to the image data having data conversion to output the second B type dimming signal VBR-B2. The second B type dimming signal VBR-B2 is synchronized with the data signal.

Since the dimming signal modulation portion 532*c* receives one of the first B type dimming signal VBR-B1 of a converted PWM signal and the first B type dimming signal VBR-B1 of a PWM signal, the dimming signal modulation portion 532*c* outputs the second B type dimming signal VBR-B2 of a PWM signal to the inverter unit 550. Accordingly, the timing controller 532 has one output terminal, i.e., a PWM output terminal PWM-OUT for the second B type dimming signal VBR-B2, and the control unit 530 includes one multiplexer, i.e. the first multiplexer 534 for the first B type dimming signal VBR-B1. As a result, the control unit 530 is simplified. In addition, since the PWM signal does not require additional transmission lines for synchronization, the third cable CB is also simplified. Further, since the inverter unit 550 receives the second B type dimming signal VBR-B2 of a PWM signal, the inverter unit 550 is also simplified. The inverter unit 550 adjusts the lighting period and the luminance of the backlight unit using the A type dimming signal VBR-A supplied by the system unit 540 and the second B type dimming signal VBR-B2 supplied by the control unit 530.

Operation of the driving system is described below. The driving system is operated in the normal mode when the advanced mode enable signal AM-EN has a value of "0" by a user's selection. The system unit 540 supplies the advanced mode enable signal AM-EN of "0" to the timing controller 532 of the control unit 530 and supplies the system dimming signals including the A type dimming signal VBR-A and the first B type dimming signal VBR-B1 to the inverter unit 550. The inverter unit 550 transmits the first B type dimming signal VBR-B1 to the timing controller 532 of the control unit 530 through the first multiplexer 534. When the first B type dimming signal VBR-B1 is an analog DC voltage signal, the timing controller 532 converts the analog DC voltage signal to a converted PWM signal. In addition, the timing controller 532 just outputs the first B type dimming signal VBR-B1 as the second B type dimming signal VBR-B2. Alternatively, the timing controller 532 may modulate the first B type dimming signal VBR-B1 to be synchronized with the data signal and may output the modulated first B type dimming signal VBR-B1 as the second B type dimming signal VBR-B2. The second B type dimming signal VBR-B2 of a PWM signal is input to the inverter unit 550, and the inverter unit 550 adjusts the lighting period and the luminance of the backlight unit using at least one of the A type dimming signal VBR-A and the second B type dimming signal VBR-B2. As a result, the LCD device including the driving system is operated in the normal mode where the power consumption is reduced by reducing the lighting period of the backlight unit without improving the contrast ratio or converting the image data.

The driving system is operated in the advanced mode when the advanced mode enable signal AM-EN has a value of "1" by a user's selection. The system unit 540 supplies the advanced mode enable signal AM-EN of "1" to the timing controller 532 of the control unit 530 and supplies the system dimming signals including the A type dimming signal VBR-A and the first B type dimming signal VBR-B1 to the inverter unit 550. The inverter unit 550 transmits the first B type dimming signal VBR-B1 to the timing controller 532 of the control unit 530 through the first multiplexer 534. When the first B type dimming signal VBR-B1 is an analog DC voltage signal, the timing controller 532 converts the analog DC voltage signal to a converted PWM signal. In addition, the timing controller 532 converts the image data and generates the conversion status signal for reducing power consumption and improving contrast ratio. Further, the timing controller 532 modulates the first B type dimming signal VBR-B1 on the basis of the conversion status signal corresponding to the image data having data conversion to output the second B type dimming signal VBR-B2. The second B type dimming signal VBR-B2 of a PWM signal is input to the inverter unit 550, and the inverter unit 550 adjusts the lighting period and the luminance of the backlight unit using at least one of the A type dimming signal VBR-A and the second B type dimming signal VBR-B2. Since the adjustment of the backlight unit using the second B type dimming signal VBR-B2 has further reduced the lighting period and further reduced the luminance as compared with the adjustment of the backlight unit using the first B type dimming signal VBR-B1, the LCD device including the driving system is operated in the advanced mode where power consumption is reduced and contrast ratio is improved with data conversion.

In the driving system for operating the LCD device in the normal mode and the advanced mode, an additional pin is required in each of the first and second connectors CN1 and CN2 since an additional transmission line is required for transmitting the advanced mode enable signal AM-EN from the system unit 540 to the control unit 530. Therefore, the control unit 530 and the inverter unit 540 of the driving system according to the fifth embodiment of the present invention may be implemented using a general system unit of an LCD device that operates only in the normal mode (i.e., has an unused dummy pin). The unused dummy pin on the general system unit may be used as the additional pin. Accordingly, the LCD device may be selectively operated in the normal mode and the advanced mode without changing the design of the pin map. In addition, since the control unit 530 outputs the second B type dimming signal VBR-B2 of a PWM signal regardless of the kind of the first B type dimming signal VBR-B1, the control unit 530, the inverter unit 550, and the third cable CB3 are simplified.

Although the advanced mode enable signal AM-EN is directly transmitted from the system unit 540 to the control unit 530 in the fifth embodiment, the advanced mode enable signal AM-EN may be transmitted from the system unit 540 to the control unit 530 through the inverter unit 550 in an alternative embodiment. For example, the advanced mode enable signal AM-EN may be transmitted from the system unit 540 to the inverter unit 550 through the third connector CN3, the second cable CB2, and the fourth connector CN4. The advanced mode enable signal AM-EN may then be transmitted from the inverter unit 550 to the control unit 530 through the fifth connector CN5, the third cable CB3, and the sixth connector CN6. As a result, no additional transmission line is required in the first cable CB1, and no additional pin is required in each of the first and second connectors CN1 and CN2. Accordingly, the control unit 530 and the inverter unit 540 in the alternative embodiment may be implemented using a general system unit without changing the design of the pin map.

Figure 11:
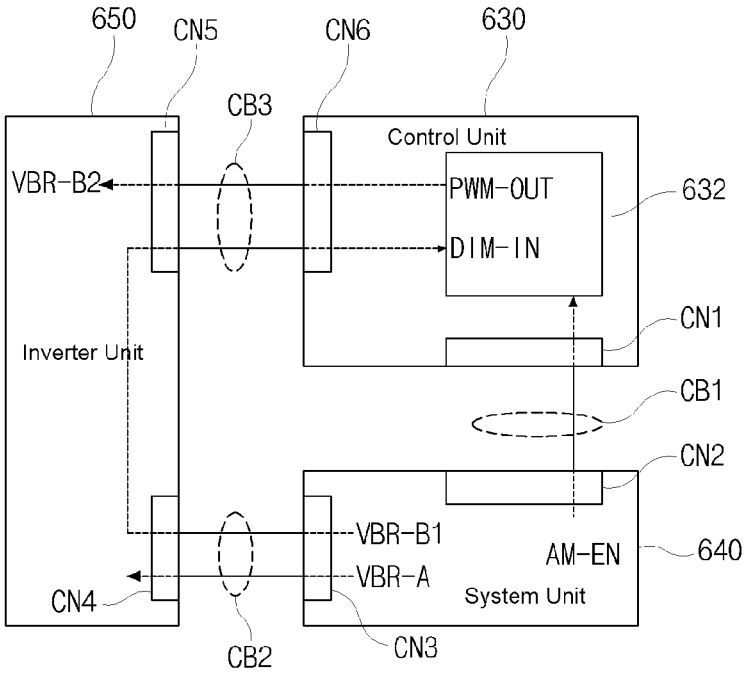
FIG. 11 is a view showing an exemplary driving system for a liquid crystal display device according to a sixth embodiment of the present invention.
Figure 12:
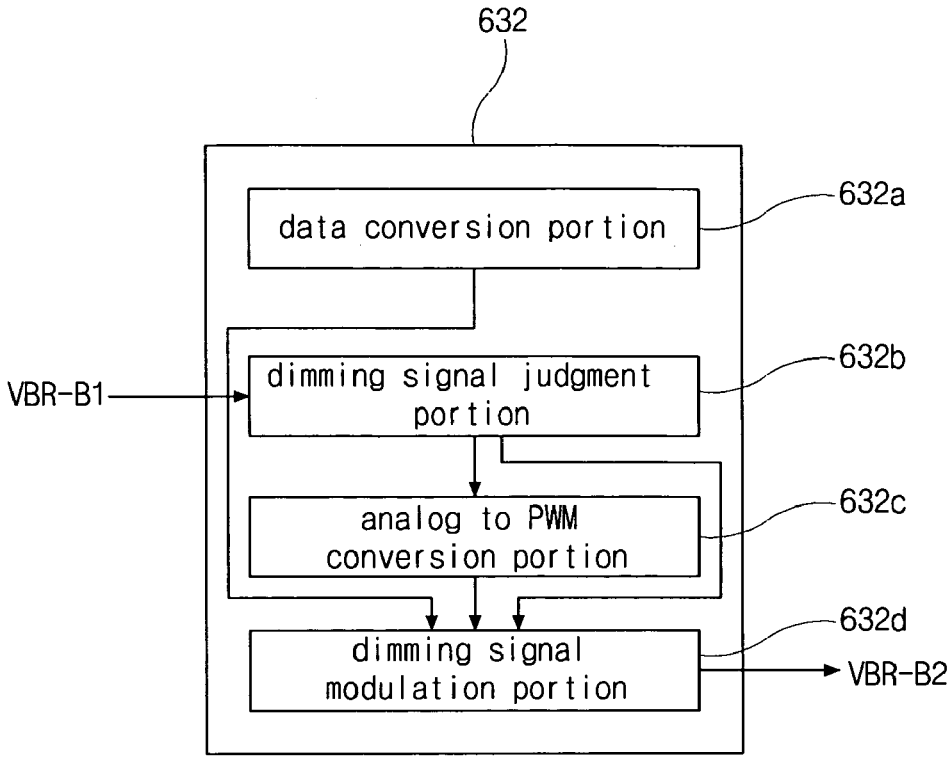
FIG. 12 is a view showing an exemplary timing controller of the driving system of FIG. 11.
Figure 13:
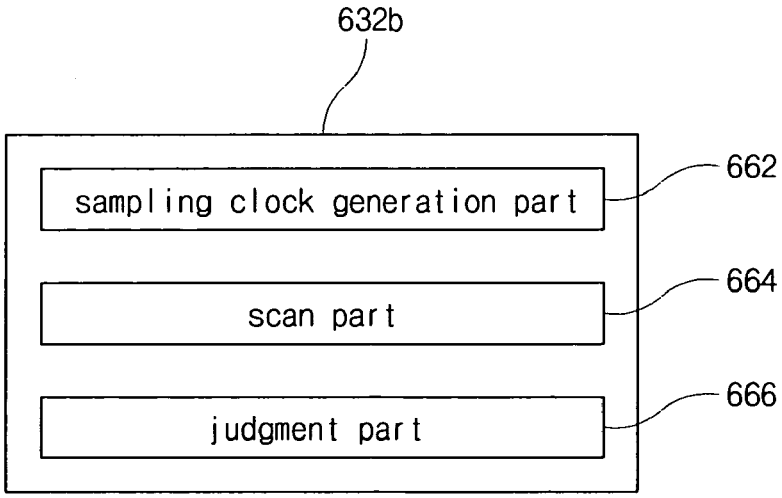
FIG. 13 is a view showing an exemplary dimming signal judgment portion of the timing controller of FIG. 12.

FIG. 11 is a view showing an exemplary driving system for a liquid crystal display device according to a sixth embodiment of the present invention. FIG. 12 is a view showing an exemplary timing controller of the driving system of FIG. 11. FIG. 13 is a view showing an exemplary dimming signal judgment portion of the timing controller of FIG. 12. The driving system of FIG. 11 has similar structure with the driving system of FIG. 4. Accordingly, illustrations and descriptions about the same parts are not repeated.

In FIG. 11, the driving system of the LCD device includes a control unit 630, a system unit 640, and an inverter unit 650. The LCD device is operated in one of a normal mode, in which power consumption is reduced without improvement of contrast ratio, and an advanced mode, in which contrast ratio is improved with reduction of power consumption. The control unit 630 is coupled with the system unit 640 through a first cable CB1, and the system unit 640 is coupled with the inverter unit 650 through a second cable CB2. The inverter unit 650 is coupled with the control unit 630 through a third cable CB3. Each of the first to sixth connectors CN1 to CN6 may include at least one transmission line. Further, each of the third and fourth connectors CN3 and CN4 may include 14 pins and each of the fifth and sixth connectors CN5 and CN6 may include 4 pins.

The system unit 640 generates an advanced mode enable signal AM-EN according to a user's selection and supplies the advanced mode enable signal AM-EN to the control unit 630 through the first cable CB1. The LCD device may be operated in one of the normal mode and the advanced mode according to the advanced mode enable signal AM-EN. The advanced mode enable signal AM-EN is input to a timing controller 632. For example, when the advanced mode enable signal AM-EN has a low value (e.g., "0," or disable), the timing controller 632 generates a normal control dimming signal for reducing power consumption without image data conversion for improving contrast ratio, thereby operating the LCD device in the normal mode. When the advanced mode enable signal AM-EN has a high value (e.g., "1," or enable), the timing controller 632 converts the image data and generates an advanced control dimming signal based on the image data conversion, thereby operating the LCD device in the advanced mode. The normal control dimming signal and the advanced control dimming signal are transmitted to the inverter unit 650 as the second B type dimming signal VBR-B2.

The system unit 640 may include an external interface circuit, such as a television system and a graphic card, to supply various driving signals such as image data, a main clock signal, a horizontal synchronization signal, a vertical synchronization signal, and the advanced mode enable signal AM-EN to the control unit 630. In addition, the system unit 640 generates system dimming signals for adjusting lighting period and illumination of the backlight unit. For example, the system unit 640 may generate an A type dimming signal VBR-A and a first B type dimming signal VBR-B1 as the system dimming signal. In addition, the system unit 640 supplies the A type dimming signal VBR-A and the first B type dimming signal VBR-B1 to the inverter unit 650 through the second cable CB2.

The inverter unit 650 transmits the first B type dimming signal VBR-B1 to the control unit 630 through the third cable CB3. Accordingly, the first B type dimming signal VBR-B1 is transmitted from the system unit 640 to the control unit 630 through the inverter unit 650 as a bypass with the second and third cables CB2 and CB3 for transmitting the first B type dimming signal VBR-B1. The first B type dimming signal VBR-B1 is input to the timing controller 632 of the control unit 630.

The control unit 630 includes the timing controller 632. The timing controller 632 may include an integrated circuit (IC). Although not shown in FIG. 11, the timing controller 632 generates a data signal using the image data, the main clock signal, the horizontal synchronization signal, and the vertical synchronization signal supplied by the system unit 640 and supplies the data signal to the liquid crystal panel.

Further, as shown in FIG. 12, the timing controller 632 includes a data conversion portion 632*a*, a dimming signal judgment portion 632*b*, an analog-to-PWM conversion portion 632*c*, and a dimming signal modulation portion 632*d*. The first B type dimming signal VBR-B1 transmitted to the control unit 630 through the inverter unit 650 is one of a PWM signal and an analog DC voltage signal. The first B type dimming signal VBR-B1 is input to the dimming signal judgment portion 632*b*. The dimming signal judgment portion 632*b* judges the kind of signal the first B type dimming signal VBR-B1 is and transmits the first B type dimming signal VBR-B1 to one of the analog-to-PWM conversion portion 632*c* and the dimming signal modulation portion 632*d* according to the kind of the first B type dimming signal VBR-B1.

When the first B type dimming signal VBR-B1 is a PWM signal, the dimming signal judgment portion 632*b* transmits the first B type dimming signal VBR-B1 to the dimming signal modulation portion 632*d*. When the first B type dimming signal VBR-B1 is an analog DC voltage signal, the dimming signal judgment portion 632*b* transmits the first B type dimming signal VBR-B1 to the analog-to-PWM conversion portion 632*c*. The analog-to-PWM conversion portion 632*c* converts the first B type dimming signal VBR-B1 of the analog DC voltage signal into a converted PWM signal as the first B type dimming signal VBR-B1. The first B type dimming signal VBR-B1 of the converted PWM signal is transmitted to the dimming signal modulation portion 632*d*. Further, a second B type dimming signal VBR-B2 is output from the dimming signal modulation portion 632*d*. The second B type dimming signal VBR-B2 is transmitted to the inverter unit 650 through the third cable CB3.

As shown in FIG. 13, the dimming signal judgment portion 632*b* includes a sampling clock generation part 662, a scan part 664, and a judgment part 666. The sampling clock generation part 662 supplies a sampling clock having a predetermined frequency, e.g., a frequency within a range of about 100 kHz to about 135 kHz, for judging the kind of the first B type dimming signal VBR-B1. The scan part 664 detects a voltage level of the first B type dimming signal VBR-B1 during a predetermined scan time period, e.g., one vertical synchronization time period or several horizontal synchronization time periods according to the sampling clock. The judgment part 666 determines the kind of the first B type dimming signal VBR-B1 according to detection of a minimum voltage level, e.g., about 0.0V. For example, the scan part 664 scans the voltage level of the first B type dimming signal VBR-B1 according to the frequency of the sampling clock during the scan time period. When the minimum voltage level is not detected, the first B type dimming signal VBR-B1 may be determined as an analog DC voltage signal and may be transmitted to the analog-to-PWM conversion portion 632*c*. Otherwise, the first B type dimming signal VBR-B1 may be determined as a PWM signal and may be transmitted to the dimming modulation portion 632*d*.

When the first B type dimming signal VBR-B1 is an analog DC voltage signal, the analog-to-PWM conversion portion 632*c* converts the analog DC voltage signal to a digital signal and then converts the digital signal to a converted PWM signal having a high width ratio corresponding to a voltage level of the analog DC voltage signal. The analog DC voltage signal may be converted to the digital signal using an analog to digital converter (ADC). The conversion from the analog DC voltage signal to the converted PWM signal in the timing controller 632 of the sixth embodiment is similar with the conversion in the timing controller 532 of the fifth embodiment. Accordingly, as shown in FIG. 10, when the analog DC voltage signal has a voltage level within a range of about 0.0V to about 3.3V, the converted PWM signal may have a high width ratio within a range of about 30% to about 100%. For example, the analog DC voltage signal may be converted to the converted PWM signal such that the minimum and maximum voltage levels, i.e., about 0.0V and about 3.3V, correspond to the high width ratios of about 30% and about 100%, respectively. The correspondence between the voltage level and the high width ratio may be determined differently in alternative embodiments.

Since the first B type dimming signal of the converted PWM signal of the analog-to-PWM conversion portion 632*c* or the first B type dimming signal VBR-B1 of the PWM signal of the system unit 640 is transmitted to the dimming signal modulation portion 632*d*, the dimming signal modulation portion 632*d* receives the PWM signal regardless of the kind of the first B type dimming signal VBR-B1 in the system unit 640, i.e., whether the first B type dimming signal is a PWM signal or an analog DC voltage signal. That is, the second B type dimming signal VBR-B2 output from the dimming signal modulation portion 632*d* is a PWM signal when the first B type dimming signal VBR-B1 is a PWM signal or when the first B type dimming signal VBR-B1 is an analog DC voltage signal.

When the advanced mode enable signal AM-EN of "0" is input to the timing controller 632, the data conversion portion 632*a* does not convert gray levels of the image data and generates a conversion status signal corresponding to the image data having no data conversion. Accordingly, the data signal corresponding to the image data is supplied to the liquid crystal panel without conversion (e.g., no data stretching). The dimming signal judgment portion 632*b* transmits the first B type dimming signal VBR-B1 of a PWM signal to the dimming signal modulation portion 632*d* and the first B type dimming signal VBR-B1 of an analog DC voltage signal to the analog-to-PWM conversion portion 632*c*. In addition, the analog-to-PWM conversion portion 632*c* converts the first B type dimming signal VBR-B1 of an analog DC voltage signal into a converted PWM signal as the first B type dimming signal VBR-B1, and the first B type dimming signal VBR-B1 of the converted PWM signal is transmitted to the dimming signal modulation portion 632*d*. As a result, the dimming signal modulation portion 632*d* receives the first B type dimming signal VBR-B1 of the converted PWM signal from the analog-to-PWM conversion portion 632*c* or the first B type dimming signal VBR-B1 of the PWM signal from the system unit 640. Further, the dimming signal modulation portion 632*d* may just output the first B type dimming signal VBR-B1 as the second B type dimming signal VBR-B2 on the basis of the conversion status signal corresponding to the image data having no data conversion. Alternatively, the dimming signal modulation portion 632*d* may modulate the first B type dimming signal VBR-B1 to be synchronized with the data signal and may output the modulated first B type dimming signal VBR-B1 as the second B type dimming signal VBR-B2 on the basis of the conversion status signal corresponding to the image data having no data conversion in an alternative embodiment.

When the advanced mode enable signal AM-EN of "1" is input to the timing controller 632, the data conversion portion 632*a* converts gray levels of the image data (e.g., data stretching), and the data signal corresponding to the converted image data is supplied to the liquid crystal panel. In addition, the conversion status signal corresponding to the image data having data conversion is transmitted from the data conversion portion 632*a* to the dimming signal modulation portion 632*d*. The analog-to-PWM conversion portion 632*c* converts the first B type dimming signal VBR-B1 of an analog DC voltage signal into a converted PWM signal as the first B type dimming signal VBR-B1, and the first B type dimming signal VBR-B1 of the converted PWM signal is transmitted to the dimming signal modulation portion 632*d*. The dimming signal modulation portion 632*d* receives the first B type dimming signal VBR-B1 of the converted PWM signal from the analog-to-PWM conversion portion 632*c* or the first B type dimming signal VBR-B1 of a PWM signal from the system unit 640. In addition, the dimming signal modulation portion 632*d* modulates the first B type dimming signal VBR-B1 on the basis of the conversion status signal corresponding to the image data having data conversion to output the second B type dimming signal VBR-B2. The second B type dimming signal VBR-B2 is synchronized with the data signal.

Since the first B type dimming signal VBR-B1 is input to the dimming signal judgment portion 632*b*, the timing controller 632 has one input terminal, i.e., a DIM input terminal DIM-IN for the first B type dimming signal VBR-B1. In addition, since the dimming signal modulation portion 632*d* receives one of the first B type dimming signal VBR-B1 of the converted PWM signal and the first B type dimming signal VBR-B1 of the PWM signal, the dimming signal modulation portion 632*d* outputs the second B type dimming signal VBR-B2 of a PWM signal to the inverter unit 650. Accordingly, the timing controller 632 has one output terminal, i.e., a PWM output terminal PWM-OUT for the second B type dimming signal VBR-B2. As a result, the control unit 630 does not require any multiplexer for the first and second B type dimming signals VBR-B1 and VBR-B2, thereby simplifying the control unit 630. In addition, since the PWM signal does not require additional transmission lines for synchronization, the third cable CB is also simplified. Further, since the inverter unit 650 receives the second B type dimming signal VBR-B2 of a PWM signal, the inverter unit 650 is also simplified. The inverter unit 650 adjusts the lighting period and the luminance of the backlight unit using the A type dimming signal VBR-A supplied by the system unit 640 and the second B type dimming signal VBR-B2 supplied by the control unit 630.

Operation of the driving system is described below. The driving system is operated in the normal mode when the advanced mode enable signal AM-EN has a value of "0" by a user's selection. The system unit 640 supplies the advanced mode enable signal AM-EN of "0" to the timing controller 632 of the control unit 630 and supplies the system dimming signals including the A type dimming signal VBR-A and the first B type dimming signal VBR-B1 to the inverter unit 650. The inverter unit 650 transmits the first B type dimming signal VBR-B1 to the timing controller 632 of the control unit 630. The timing controller 632 judges the kind of the first B type dimming signal VBR-B1 is input. When the first B type dimming signal VBR-B1 is an analog DC voltage signal, the timing controller 632 converts the analog DC voltage signal to a converted PWM signal. In addition, the timing controller 632 just outputs the first B type dimming signal VBR-B1 as the second B type dimming signal VBR-B2. Alternatively, the timing controller 632 may modulate the first B type dimming signal VBR-B1 to be synchronized with the data signal and may output the modulated first B type dimming signal VBR-B1 as the second B type dimming signal VBR-B2. The second B type dimming signal VBR-B2 of a PWM signal is input to the inverter unit 650, and the inverter unit 650 adjusts the lighting period and the luminance of the backlight unit using at least one of the A type dimming signal VBR-A and the second B type dimming signal VBR-B2. As a result, the LCD device including the driving system is operated in the normal mode where the power consumption is reduced by reducing the lighting period of the backlight unit without improving the contrast ratio or converting the image data.

The driving system is operated in the advanced mode when the advanced mode enable signal AM-EN has a value of "1" by a user's selection. The system unit 640 supplies the advanced mode enable signal AM-EN of "1" to the timing controller 632 of the control unit 630 and supplies the system dimming signals including the A type dimming signal VBR-A and the first B type dimming signal VBR-B1 to the inverter unit 650. The inverter unit 650 transmits the first B type dimming signal VBR-B1 to the timing controller 632 of the control unit 630. The timing controller 632 judges the kind of the first B type dimming signal VBR-B1 that is input. When the first B type dimming signal VBR-B1 is an analog DC voltage signal, the timing controller 632 converts the analog DC voltage signal to a converted PWM signal. In addition, the timing controller 632 converts the image data and generates the conversion status signal for reducing power consumption and improving contrast ratio. Further, the timing controller 632 modulates the first B type dimming signal VBR-B1 on the basis of the conversion status signal corresponding to the image data having data conversion to output the second B type dimming signal VBR-B2. The second B type dimming signal VBR-B2 of a PWM signal is input to the inverter unit 650, and the inverter unit 650 adjusts the lighting period and the luminance of the backlight unit using at least one of the A type dimming signal VBR-A and the second B type dimming signal VBR-B2. Since the adjustment of the backlight unit using the second B type dimming signal VBR-B2 has further reduced the lighting period and further reduced the luminance as compared with the adjustment of the backlight unit using the first B type dimming signal VBR-B1, the LCD device including the driving system is operated in the advanced mode where power consumption is reduced and contrast ratio is improved with data conversion.

In the driving system for operating the LCD device in the normal mode and the advanced mode, an additional pin is required in each of the first and second connectors CN1 and CN2 since an additional transmission line is required for transmitting the advanced mode enable signal AM-EN from the system unit 640 to the control unit 630. Therefore, the control unit 630 and the inverter unit 640 of the driving system according to the sixth embodiment of the present invention may be implemented using a general system unit of an LCD device that operates only in the normal mode (i.e., has an unused dummy pin). The unused dummy pin on the general system unit may be used as the additional pin. Accordingly, the LCD device may be selectively operated in the normal mode and the advanced mode without changing the design of the pin map. In addition, since the control unit 630 outputs the second B type dimming signal VBR-B2 of a PWM signal regardless of the kind of the first B type dimming signal VBR-B1, the control unit 530, the inverter unit 650, and the third cable CB3 are simplified.

Although the advanced mode enable signal AM-EN is directly transmitted from the system unit 640 to the control unit 630 in the sixth embodiment, the advanced mode enable signal AM-EN may be transmitted from the system unit 640 to the control unit 630 through the inverter unit 650 in an alternative embodiment. For example, the advanced mode enable signal AM-EN may be transmitted from the system unit 640 to the inverter unit 650 through the third connector CN3, the second cable CB2, and the fourth connector CN4. The advanced mode enable signal AM-EN may then be transmitted from the inverter unit 650 to the control unit 630 through the fifth connector CN5, the third cable CB3, and the sixth connector CN6. As a result, no additional transmission line is required in the first cable CB1, and no additional pin is required in each of the first and second connectors CN1 and CN2. Accordingly, the control unit 630 and the inverter unit 640 in the alternative embodiment may be implemented using a general system unit without changing the design of the pin map.

Figure 14:
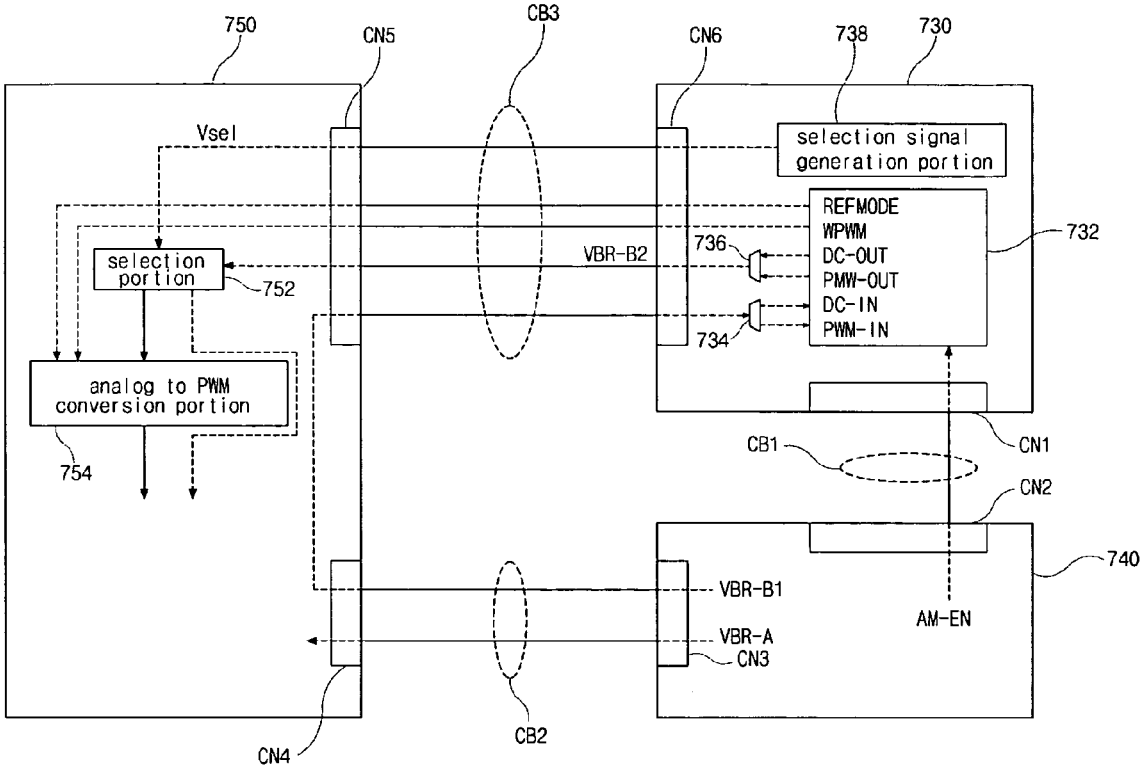
FIG. 14 is a view showing an exemplary driving system for a liquid crystal display device according to a seventh embodiment of the present invention.
Figure 15:
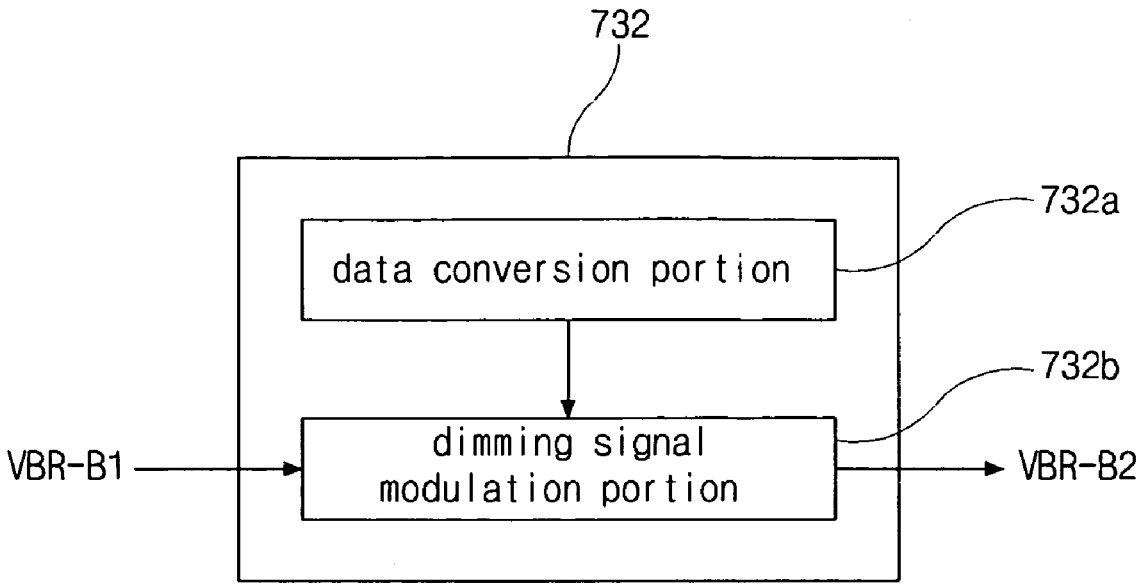
FIG. 15 is a view showing an exemplary timing controller of the driving system of FIG. 14.

FIG. 14 is a view showing an exemplary driving system for a liquid crystal display device according to a seventh embodiment of the present invention. FIG. 15 is a view showing an exemplary timing controller of the driving system of FIG. 14. The driving system of FIG. 14 has similar structure with the driving system of FIG. 4. Accordingly, illustrations and descriptions about the same parts are not repeated.

In FIG. 14, the driving system of the LCD device includes a control unit 730, a system unit 740, and an inverter unit 750. The LCD device is operated in one of a normal mode, in which power consumption is reduced without improvement of contrast ratio, and an advanced mode where contrast ratio is improved with reduction of power consumption. The control unit 730 is coupled with the system unit 740 through a first cable CB1, and the system unit 740 is coupled with the inverter unit 750 through a second cable CB2. The inverter unit 750 is coupled with the control unit 730 through a third cable CB3. Each of the first to sixth connectors CN1 to CN6 may include at least one transmission line. Further, each of the third and fourth connectors CN3 and CN4 may include 14 pins and each of the fifth and sixth connectors CN5 and CN6 may include 6 pins.

The system unit 740 generates an advanced mode enable signal AM-EN according to a user's selection and supplies the advanced mode enable signal AM-EN to the control unit 730 through the first cable CB1. The LCD device may be operated in one of the normal mode and the advanced mode according to the advanced mode enable signal AM-EN. The advanced mode enable signal AM-EN is input to a timing controller 732. For example, when the advanced mode enable signal AM-EN has a low value (e.g., "0," or disable), the timing controller 732 generates a normal control dimming signal for reducing power consumption without image data conversion for improving contrast ratio, thereby operating the LCD device in the normal mode. When the advanced mode enable signal AM-EN has a high value (e.g., "1," or enable), the timing controller 732 converts the image data and generates an advanced control dimming signal based on the image data conversion, thereby operating the LCD device in the advanced mode. The normal control dimming signal and the advanced control dimming signal are transmitted to the inverter unit 750 as the second B type dimming signal VBR-B2 through a second multiplexer 736.

The system unit 740 may include an external interface circuit, such as a television system and a graphic card, to supply various driving signals such as image data, a main clock signal, a horizontal synchronization signal, a vertical synchronization signal, and the advanced mode enable signal AM-EN to the control unit 730. In addition, the system unit 740 generates system dimming signals for adjusting lighting period and illumination of the backlight unit. For example, the system unit 740 may generate an A type dimming signal VBR-A and a first B type dimming signal VBR-B1 as the system dimming signal. In addition, the system unit 740 supplies the A type dimming signal VBR-A and the first B type dimming signal VBR-B1 to the inverter unit 750 through the second cable CB2.

The inverter unit 750 transmits the first B type dimming signal VBR-B1 to the control unit 730 through the third cable CB3. Accordingly, the first B type dimming signal VBR-B1 is transmitted from the system unit 740 to the control unit 730 through the inverter unit 750 as a bypass with the second and third cables CB2 and CB3 for transmitting the first B type dimming signal VBR-B1. The first B type dimming signal VBR-B1 is input to a first multiplexer 732 of the control unit 730.

The control unit 730 includes the timing controller 732, the first multiplexer 732, the second multiplexer 734, and a selection signal generation portion 738. The timing controller 732 may include an integrated circuit (IC). Although the first and second multiplexers 734 and 736 are shown as being formed independently of the timing controller 732 in FIG. 14, the first and second multiplexers 734 and 736 may be integrated in the timing controller 732 in an alternative embodiment. In addition, although not shown in FIG. 14, the timing controller 732 generates a data signal using the image data, the main clock signal, the horizontal synchronization signal, and the vertical synchronization signal supplied by the system unit 740 and supplies the data signal to the liquid crystal panel.

Further, as shown in FIG. 15, the timing controller 732 includes a data conversion portion 732*a* and a dimming signal modulation portion 732*b*. The first B type dimming signal VBR-B1 is input to the dimming signal modulation portion 732*b* through the first multiplexer 734, and a second B type dimming signal VBR-B2 is output from the dimming signal modulation portion 732*b* through the second multiplexer 736. The second B type dimming signal VBR-B2 is transmitted to the inverter unit 750 through the third cable CB3.

When the advanced mode enable signal AM-EN of "0" is input to the timing controller 732, the data conversion portion 732*a* does not convert gray levels of the image data, and a conversion status signal corresponding to no data conversion is output from the data conversion portion 732*a*. Accordingly, data signals corresponding to the image data are supplied to the liquid crystal panel without conversion (e.g., no data stretching). The dimming signal modulation portion 732*b* may just output the first B type dimming signal VBR-B1 as the second B type dimming signal VBR-B2 on the basis of the conversion status signal corresponding to the image data having no data conversion. Alternatively, the dimming signal modulation portion 732*b* may modulate the first B type dimming signal VBR-B1 to be synchronized with the data signal and may output the modulated first B type dimming signal VBR-B1 as the second B type dimming signal VBR-B2 on the basis of the conversion status signal corresponding to the image data having no data conversion in an alternative embodiment.

When the advanced mode enable signal AM-EN of "1" is input to the timing controller 732, the data conversion portion 732*a* converts gray levels of the image data (e.g., data stretching), and the data signal corresponding to the converted image data is supplied to the liquid crystal panel. In addition, the conversion status signal corresponding to the image data having data conversion is transmitted from the data conversion portion 732*a* to the dimming signal modulation portion 732*b*. The dimming signal modulation portion 732*b* modulates the first B type dimming signal VBR-B1 on the basis of the conversion status signal corresponding to the image data having no data conversion to output the second B type dimming signal VBR-B2. The second B type dimming signal VBR-B2 is synchronized with the data signal.

The first and second B type dimming signals VBR-B1 and VBR-B2, respectively, may be one of a PWM signal and an analog DC voltage signal. By selection of the first multiplexer 734, the first B type dimming signal VBR-B1 of the PWM signal is input to a PWM input terminal PWM-IN of the timing controller 732, and the first B type dimming signal VBR-B1 of the analog DC signal is input to a DC input terminal DC-IN of the timing controller 732. In addition, by selection of the second multiplexer 736, the second B type dimming signal VBR-B2 of the PWM signal is output from a PWM output terminal PWM-OUT of the timing controller 732, and the second B type dimming signal VBR-B2 of the analog DC signal is output from a DC output terminal DC-OUT of the timing controller 732.

The timing controller 732 further includes a mode output terminal REFMODE and a synchronization output terminal WPWM. A mode signal corresponding to a display type, such as National Television System Committee (NTSC) and Phase Alternating Line (PAL), is output from the mode output terminal REFMODE, and a synchronization signal corresponding to the data signal is output from the synchronization output terminal WPWM.

The selection signal generation portion 738 generates a selection signal Vsel corresponding to the kind of the second B type dimming signal VBR-B2 and supplies the selection signal Vsel to the inverter unit 750. For example, the selection signal generation portion 738 may include a switch using a resistor, and the selection signal may have a different voltage according to the user's selection. The second B type dimming signal VBR-B2, the selection signal Vsel, the mode signal, and the synchronization signal are transmitted to the inverter unit 750 through the third cable CB3.

The inverter unit 750 includes a selection portion 752 and an analog-to-PWM conversion portion 754. The selection portion 752 receives the selection signal Vsel and the second B type dimming signal VBR-B2. The selection portion 752 processes the second B type dimming signal VBR-B2 according to the selection signal Vsel. For example, when the second B type dimming signal VBR-B2 is an analog DC voltage signal, the selection portion 752 transmits the second B type dimming signal VBR-B2 to the analog-to-PWM conversion portion 754 according to the selection signal Vsel. The analog-to-PWM conversion portion 754 converts the second B type dimming signal VBR-B2 on the basis of the mode signal and the synchronization signal. In addition, when the second B type dimming signal VBR-B2 is a PWM signal, the selection portion 752 just outputs the second B type dimming signal VBR-B2 of the PWM signal according to the selection signal Vsel.

When the analog-to-PWM conversion portion 754 receives the second B type dimming signal VBR-B2 of the analog DC voltage signal, the analog-to-PWM conversion portion 754 converts the analog DC voltage signal to a digital signal and then converts the digital signal to a converted PWM signal having a high width ratio corresponding to a voltage level of the analog DC voltage signal. The analog DC voltage signal may be converted to the digital signal using an analog to digital converter (ADC). The conversion from the analog DC voltage signal to the converted PWM signal in the inverter unit 750 of the seventh embodiment is similar with the conversion in the timing controller 532 of the fifth embodiment. Accordingly, as shown in FIG. 10, when the analog DC voltage signal has a voltage level within a range of about 0.0V to about 3.3V, the converted PWM signal may have a high width ratio within a range of about 30% to about 100%. For example, the analog DC voltage signal may be converted to the converted PWM signal such that the minimum and maximum voltage levels, i.e., about 0.0V and about 3.3V, correspond to the high width ratios of about 30% and about 100%, respectively. The correspondence between the voltage level and the high width ratio may be determined differently in alternative embodiments. The analog-to-PWM conversion portion 754 outputs the second B type dimming signal of a converted PWM signal.

As a result, since the second B type dimming signal VBR-B2 of the PWM signal is output from the selection portion 752 or the second B type dimming signal VBR-B2 of the converted PWM signal is output from the analog-to-PWM conversion portion 754, the inverter unit 750 has the second B type dimming signal VBR-B2 of a PWM signal regardless of the kind of the first B type dimming signal VBR-B1 in the system unit 740, i.e., whether the first B type dimming signal VBR-B1 is a PWM signal or an analog DC voltage signal. Accordingly, the inverter unit 750 adjusts the lighting period and the luminance of the backlight unit using the A type dimming signal VBR-A supplied by the system unit 740 and the second B type dimming signal VBR-B2 output from the selection portion 752 or from the analog-to-PWM conversion portion 754. Since the inverter unit 750 uses the second B type dimming signal VBR-B2 of a PWM signal regardless of the kind of the first B type dimming signal VBR-B1, the inverter unit 750 is simplified Operation of the driving system is described below. The driving system is operated in the normal mode when the advanced mode enable signal AM-EN has a value of "0" by a user's selection. The system unit 740 supplies the advanced mode enable signal AM-EN of "0" to the timing controller 732 of the control unit 730 and supplies the system dimming signals including the A type dimming signal VBR-A and the first B type dimming signal VBR-B1 to the inverter unit 750. The inverter unit 750 transmits the first B type dimming signal VBR-B1 to the timing controller 732 of the control unit 730 through the first multiplexer 734. The timing controller 732 just outputs the first B type dimming signal VBR-B1 as the second B type dimming signal VBR-B2. Alternatively, the timing controller 732 may modulate the first B type dimming signal VBR-B1 to be synchronized with the data signal and may output the modulated first B type dimming signal VBR-B1 as the second B type dimming signal VBR-B2. The second B type dimming signal VBR-B2 is input to the inverter unit 750 through the second multiplexer 746. In addition, the selection signal Vsel, the mode signal, and the synchronization signal of the control unit 730 are input to the inverter unit 750. According to the selection signal Vsel, the inverter unit 750 just outputs the second B type dimming signal VBR-B2 of a PWM signal, or the inverter unit 750 converts the second B type dimming signal VBR-B2 of an analog DC voltage signal into a converted PWM signal as the second B type dimming signal VBR-B2 using the mode signal and the synchronization signal. Further, the inverter unit 750 adjusts the lighting period and the luminance of the backlight unit using at least one of the A type dimming signal VBR-A and the second B type dimming signal VBR-B2. As a result, the LCD device including the driving system is operated in the normal mode where the power consumption is reduced by reducing the lighting period of the backlight unit without improving the contrast ratio or converting the image data.

The driving system is operated in the advanced mode when the advanced mode enable signal AM-EN has a value of "1" by a user's selection. The system unit 740 supplies the advanced mode enable signal AM-EN of "1" to the timing controller 532 of the control unit 730 and supplies the system dimming signals including the A type dimming signal VBR-A and the first B type dimming signal VBR-B1 to the inverter unit 750. The inverter unit 750 transmits the first B type dimming signal VBR-B1 to the timing controller 732 of the control unit 730 through the first multiplexer 734. The timing controller 732 converts the image data and generates the conversion status signal corresponding to the image data having data conversion for reducing power consumption and improving contrast ratio. Further, the timing controller 732 modulates the first B type dimming signal VBR-B1 on the basis of the conversion status signal corresponding to the image data having data conversion to output the second B type dimming signal VBR-B2. The second B type dimming signal VBR-B2 is input to the inverter unit 750 through the second multiplexer 746. In addition, the selection signal Vsel, the mode signal and the synchronization signal of the control unit 730 are input to the inverter unit 750. According to the selection signal Vsel, the inverter unit 750 just outputs the second B type dimming signal VBR-B2 of a PWM signal, or the inverter unit 750 converts the second B type dimming signal VBR-B2 of an analog DC voltage signal into a converted PWM signal as the second B type dimming signal VBR-B2 using the mode signal and the synchronization signal. Further, the inverter unit 750 adjusts the lighting period and the luminance of the backlight unit using at least one of the A type dimming signal VBR-A and the second B type dimming signal VBR-B2. Since the adjustment of the backlight unit using the second B type dimming signal VBR-B2 has further reduced the lighting period and further reduced the luminance as compared with the adjustment of the backlight unit using the first B type dimming signal VBR-B1, the LCD device including the driving system is operated in the advanced mode where power consumption is reduced and contrast ratio is improved with data conversion.

In the driving system for operating the LCD device in the normal mode and the advanced mode, an additional pin is required in each of the first and second connectors CN1 and CN2 since an additional transmission line is required for transmitting the advanced mode enable signal AM-EN from the system unit 740 to the control unit 730. Therefore, the control unit 730 and the inverter unit 740 of the driving system according to the seventh embodiment of the present invention may be implemented using a general system unit of an LCD device that operates only in the normal mode (i.e., has an unused dummy pin). The unused dummy pin on the general system unit may be used as the additional pin. Accordingly, the LCD device may be selectively operated in the normal mode and the advanced mode without changing the design of the pin map.

Although the advanced mode enable signal AM-EN is directly transmitted from the system unit 740 to the control unit 730 in the seventh embodiment, the advanced mode enable signal AM-EN may be transmitted from the system unit 740 to the control unit 730 through the inverter unit 750 in an alternative embodiment. For example, the advanced mode enable signal AM-EN may be transmitted from the system unit 740 to the inverter unit 750 through the third connector CN3, the second cable CB2, and the fourth connector CN4. The advanced mode enable signal AM-EN may then be transmitted from the inverter unit 750 to the control unit 730 through the fifth connector CN5, the third cable CB3, and the sixth connector CN6. As a result, no additional transmission line is required in the first cable CB1, and no additional pin is required in each of the first and second connectors CN1 and CN2. Accordingly, the control unit 730 and the inverter unit 740 in the alternative embodiment may be implemented using a general system unit without changing the design of the pin map.

Consequently, in the driving system for an LCD device according to the present invention, the system dimming signal of the first B type dimming signal is transmitted from the system unit to the control unit through the inverter unit, and the control dimming signal of the second B type dimming signal is transmitted from the control unit to the inverter unit. Accordingly, the control unit and the inverter unit of the driving system of the present invention may be implemented using a general system unit of an LCD device since an additional transmission line is not required between the control unit and the system unit. In addition, since the inverter unit adjusts the lighting period and the luminance of the backlight unit using the control dimming signal of a PWM signal independently of the kind of the control dimming signal, the driving system is simplified.

It will be apparent to those skilled in the art that various modifications and variations can be made in the driving system and method of the present invention without departing from the spirit or scope of the invention. Thus, it is intended that the present invention cover the modifications and variations of this invention provided they come within the scope of the appended claims and their equivalents.

What is claimed is:

1. A driving system for a liquid crystal display device, comprising:

a system unit to supply image data to be displayed on a liquid crystal panel, the system unit generating a system dimming signal;

an inverter unit to control luminance of a backlight unit, the inverter unit receiving the system dimming signal; and a control unit to control display of images on the liquid crystal panel, the control unit receiving the system dimming signal from the inverter unit and outputting a control dimming signal to the inverter unit, wherein the inverter unit adjusts luminance of the backlight unit using the control dimming signal input from the control unit, and wherein the control unit includes a timing controller including a data conversion portion and a dimming signal modulation portion, the data conversion portion converting grey levels of an image data and the dimming signal modulation portion modulating the system dimming signal to output the control dimming signal, a first multiplexer to select an input terminal of the timing controller for the system dimming signal, a second multiplexer to select an output terminal of the timing controller for the control dimming signal, and a selection signal generation portion to generate a selection signal based on a type of the system dimming signal.

2. The system according to claim 1, wherein the control unit receives an advanced mode enable signal for selecting between a normal mode and an advanced mode to output the control dimming signal to the inverter unit.

3. The system according to claim 1, wherein the system dimming signal includes an A type dimming signal having an analog direct current (DC) voltage signal and a first B type dimming signal having one of an analog DC voltage signal and a pulse width modulation (PWM) signal, and the control dimming signal includes a second B type dimming signal.

4. The system according to claim 1, wherein the control dimming signal is generated by modulating the system dimming signal.

5. The system according to claim 1, wherein the control dimming signal is selected from the system dimming signal and a converted dimming signal generated by a timing controller of the control unit.

6. The system according to claim 5, wherein the control unit further includes a first multiplexer to select between the system dimming signal and the converted dimming signal.

7. The system according to claim 1, wherein the control unit includes a timing controller including a data conversion portion and a dimming signal modulation portion, the data conversion portion converting grey levels of an image data and the dimming signal modulation portion modulating the system dimming signal to generate the control dimming signal, a first multiplexer to select an input terminal of the timing controller for the system dimming signal, and a second multiplexer to select an output terminal of the timing controller for the control dimming signal.

8. The system according to claim 1, wherein the control unit includes a timing controller including a data conversion portion, an analog-to-PWM conversion portion, and a dimming signal modulation portion, the data conversion portion converting grey levels of an image data, the analog-to-PWM conversion portion converting an analog DC voltage signal of the system dimming signal to a converted PWM signal, and the dimming signal modulation portion modulating the system dimming signal to output the control dimming signal, and a first multiplexer to select an input terminal of the timing controller for the system dimming signal.

9. The system according to claim 8, wherein the analog DC voltage signal is converted to the converted PWM signal such that maximum and minimum voltage levels of the analog DC voltage signal correspond to high width ratios of about 30% and about 100% of the converted PWM signal, respectively.

10. The system according to claim 9, wherein the maximum and minimum voltage levels of the analog DC voltage signal are about 0.0V and about 3.3V, respectively.

11. The system according to claim 1, wherein the control unit includes a timing controller, the timing controller including a data conversion portion, a dimming signal judgment portion, an analog-to-PWM conversion portion, and a dimming signal modulation portion, the data conversion portion converting grey levels of an image data, the dimming signal judgment portion transmitting the system dimming signal to one of the analog-to-PWM conversion portion and the dimming signal modulation portion, the analog-to-PWM conversion portion converting an analog DC voltage signal of the system dimming signal to a converted PWM signal, and the dimming signal modulation portion modulating the system dimming signal to output the control dimming signal.

12. The system according to claim 11, wherein the dimming signal judgment portion includes a sampling clock generation part to supply a sampling clock, a scan part to detect a voltage level of the system dimming signal according to the sampling clock, and a judgment part to determine a type of the system dimming signal as being one of an analog DC voltage signal and a PWM signal according to a result of the scan part.

13. The system according to claim 12, wherein the judgment part determines the type of the system dimming signal as being the analog DC voltage signal when a minimum voltage level is not detected and as being the PWM signal when the minimum voltage level is detected.

14. The system according to claim 1, wherein the inverter unit includes a selection portion to receive the selection signal and the control dimming signal, and an analog-to-PWM conversion portion to convert an analog DC voltage signal of the control dimming signal to a converted PWM signal, wherein the selection portion transmits the control dimming signal to the analog-to-PWM conversion portion according to the selection signal.

15. The system according to claim 1, wherein the selection signal generation portion includes a switch using a resistor.

16. The system according to claim 1, wherein the control dimming signal adjusts the backlight unit to further reduce a lighting period and luminance as compared with the system dimming signal.

17. The system according to claim 1, further comprising:

a first cable to couple the control unit and the system unit;

a second cable to couple the system unit and the inverter unit; and a third cable to couple the inverter unit and the control unit.

18. The system according to claim 17, wherein the control unit includes a first connector connected to the first cable and a sixth connector connected to the third cable, the system unit includes a second connector connected to the first cable and a third connector connected to the second cable, and the inverter unit includes a fourth connector connected to the second cable and a fifth connector connected to the third cable.

19. The system according to claim 17, wherein the system unit generates an advanced mode enable signal determining an operation mode of the liquid crystal display device and the advanced mode enable signal is transmitted to the control unit through the first cable.

20. The system according to claim 17, wherein the system unit generates an advanced mode enable signal determining an operation mode of the liquid crystal display device and the advanced mode enable signal is transmitted to the control unit through the second cable, the inverter unit, and the third cable.

21. The system according to claim 17, wherein the third cable transmits the system dimming signal from the inverter unit to the control unit and the control dimming signal from the control unit to the inverter unit.

22. The system according to claim 1, wherein the system unit includes one of a television system and a graphic card to supply the image data to the control unit.

23. A liquid crystal display device, comprising:

a liquid crystal panel to display an image;

a backlight unit to supply light to the liquid crystal panel;

a system unit to supply image data to be displayed on the liquid crystal panel, the system unit generating a system dimming signal;

an inverter unit to control luminance of the backlight unit, the inverter unit receiving the system dimming signal; and a control unit to control display of the image on the liquid crystal panel, the control unit receiving the system dimming signal from the inverter unit and outputting a control dimming signal to the inverter unit, wherein the inverter unit adjusts luminance of the backlight unit using the control dimming signal input from the control unit, and wherein the control unit includes a timing controller including a data conversion portion and a dimming signal modulation portion, the data conversion portion converting grey levels of an image data and the dimming signal modulation portion modulating the system dimming signal to output the control dimming signal, a first multiplexer to select an input terminal of the timing controller for the system dimming signal, a second multiplexer to select an output terminal of the timing controller for the control dimming signal, and a selection signal generation portion to generate a selection signal based on a type of the system dimming signal.

24. The device according to claim 23, wherein the control unit receives an advanced mode enable signal for selecting between a normal mode and an advanced mode to output the control dimming signal to the inverter unit.

25. A method for driving a liquid crystal display device, comprising:

generating a system dimming signal by a system unit for supplying image data to be displayed on a liquid crystal panel and outputting the system dimming signal to an inverter unit for controlling luminance of a backlight unit;

receiving the system dimming signal and outputting the system dimming signal to a control unit for controlling display of images on the liquid crystal panel; and receiving the system dimming signal from the inverter unit and outputting a control dimming signal to the inverter unit, wherein the inverter unit adjusts a luminance of a backlight unit using the control dimming signal input from the control unit, and wherein the control unit includes a timing controller including a data conversion portion and a dimming signal modulation portion, the data conversion portion converting grey levels of an image data and the dimming signal modulation portion modulating the system dimming signal to output the control dimming signal, a first multiplexer to select an input terminal of the timing controller for the system dimming signal, a second multiplexer to select an output terminal of the timing controller for the control dimming signal, and a selection signal generation portion to generate a selection signal based on a type of the system dimming signal.

26. The method according to claim 25 further comprising receiving an advanced mode enable signal for selecting between a normal mode and an advanced mode to output the control dimming signal to the inverter unit.

* * * * *